US009542952B2

(12) United States Patent
Hatanaka et al.

(10) Patent No.: US 9,542,952 B2
(45) Date of Patent: Jan. 10, 2017

(54) DECODING DEVICE, DECODING METHOD, ENCODING DEVICE, ENCODING METHOD, AND PROGRAM

(71) Applicant: Sony Corporation, Tokyo (JP)

(72) Inventors: Mitsuyuki Hatanaka, Kanagawa (JP); Toru Chinen, Kanagawa (JP)

(73) Assignee: Sony Corporation, Tokyo (JP)

( * ) Notice: Subject to any disclaimer, the term of this patent is extended or adjusted under 35 U.S.C. 154(b) by 6 days.

(21) Appl. No.: 14/238,265

(22) PCT Filed: Jun. 24, 2013

(86) PCT No.: PCT/JP2013/067230

§ 371 (c)(1),
(2) Date: Feb. 11, 2014

(87) PCT Pub. No.: WO2014/007094

PCT Pub. Date: Jan. 9, 2014

(65) Prior Publication Data

US 2014/0156289 A1 Jun. 5, 2014

(30) Foreign Application Priority Data

Jul. 2, 2012 (JP) ..... 2012-148918
Nov. 21, 2012 (JP) ..... 2012-255462

(51) Int. Cl.
*G10L 21/00* (2013.01)
*G10L 19/008* (2013.01)
(Continued)

(52) U.S. Cl.
CPC ..... *G10L 19/008* (2013.01); *G10L 19/167* (2013.01); *H04S 3/008* (2013.01); *H04S 2400/03* (2013.01); *H04S 2400/11* (2013.01)

(58) Field of Classification Search
CPC .. H04S 2420/01; H04S 2400/11; H04S 3/008; H04S 2400/01; H04S 2420/03; H04S 7/30; H04S 7/302; H04S 3/00; H04S 2400/03; H04S 7/303; G10L 19/008; G10L 19/167
(Continued)

(56) References Cited

U.S. PATENT DOCUMENTS 4,472,803 A 9/1984 Iijima
6,680,753 B2 1/2004 Kahn
(Continued)

FOREIGN PATENT DOCUMENTS

CN 1402952 A 3/2003
CN 101180674 A 5/2008
(Continued)

OTHER PUBLICATIONS

U.S. Appl. No. 13/978,175, filed Jul. 3, 2013, Hatanaka et al.
(Continued)

*Primary Examiner* — Marivelisse Santiago Cordero
*Assistant Examiner* — Stephen Brinich
(74) *Attorney, Agent, or Firm* — Wolf, Greenfield & Sacks, P.C.

(57) ABSTRACT

The present technique relates to a decoding device, a decoding method, an encoding device, an encoding method, and a program which can obtain a high-quality realistic sound. The encoding device stores speaker arrangement information in a comment region in a PCE of an encoded bit stream and stores a synchronous word and identification information in the comment region such that other public comments and the speaker arrangement information stored in the comment region can be distinguished from each other. When an encoded bit stream is decoded, it is determined whether the speaker arrangement information is stored on the basis of the synchronous word and the identification information stored in the comment region. Audio data included in the
(Continued)

encoded bit stream is output according to the arrangement of the speakers corresponding to the determination result. The present technique can be applied to an encoding device.

4 Claims, 38 Drawing Sheets

(51) Int. Cl.
*G10L 19/16* (2013.01)
*H04S 3/00* (2006.01)

(58) Field of Classification Search
USPC ..... 704/500–501, 201, E19.001; 381/17–22, 381/1, 300, 303, 306–307
See application file for complete search history.

(56) References Cited

U.S. PATENT DOCUMENTS

| | | | |
|---|---|---|---|
| 7,403,627 | B2 | 7/2008 | Wu |
| 2002/0059643 | A1 | 5/2002 | Kitamura et al. |
| 2002/0091514 | A1 | 7/2002 | Fuchigami |
| 2002/0128822 | A1 | 9/2002 | Kahn |
| 2008/0114477 | A1 | 5/2008 | Wu |
| 2009/0034764 | A1 | 2/2009 | Ohashi |
| 2009/0216542 | A1 | 8/2009 | Pang et al. |
| 2009/0271015 | A1 | 10/2009 | Oh et al. |
| 2010/0324915 | A1 | 12/2010 | Seo et al. |
| 2011/0286535 | A1 | 11/2011 | Ko et al. |
| 2013/0275142 | A1 | 10/2013 | Hatanaka et al. |
| 2014/0211948 | A1 | 7/2014 | Hatanaka et al. |
| 2014/0214432 | A1 | 7/2014 | Hatanaka et al. |
| 2014/0214433 | A1 | 7/2014 | Hatanaka et al. |

FOREIGN PATENT DOCUMENTS

| | | | |
|---|---|---|---|
| CN | 101243490 | A | 8/2008 |
| CN | 101356572 | A | 1/2009 |
| CN | 101484935 | A | 7/2009 |
| CN | 101690269 | A | 3/2010 |
| CN | 102016981 | A | 4/2011 |
| CN | 102460571 | A | 5/2012 |
| EP | 1855506 | A2 | 11/2007 |
| EP | 2112651 | A1 | 10/2009 |
| EP | 2219313 | A1 | 8/2010 |
| EP | 2352152 | A2 | 8/2011 |
| JP | 2000-090582 | | 3/2000 |
| JP | 2000-101583 | | 4/2000 |
| JP | 2000-214889 | | 8/2000 |
| JP | 2008-301454 | | 12/2008 |
| JP | 2009-508433 | | 2/2009 |
| JP | 2009-508433 | A | 2/2009 |
| JP | 2010-505143 | | 2/2010 |
| JP | 2010-529500 | | 8/2010 |
| JP | 2010-217900 | | 9/2010 |
| JP | 2011-008258 | | 1/2011 |
| JP | 2011-066868 | | 3/2011 |
| JP | 2011-519223 | | 6/2011 |
| WO | WO 2009/001277 | A1 | 12/2008 |

OTHER PUBLICATIONS

U.S. Appl. No. 14/239,574, filed Feb. 19, 2014, Hatanaka et al.
U.S. Appl. No. 14/239,568, filed Feb. 19, 2014, Hatanaka et al.
U.S. Appl. No. 14/238,243, filed Feb. 11, 2014, Hatanaka et al.
Rettelbach et al., Proposed update to the family of AAC LC based profiles, International Organisation for Standardisation, ISO/IEC JTC1/SC29/WG11, Coding of Moving Pictures and Audio, Jul. 2012, Stockholm, Sweden, pp. 1-19.

FIG. 2

Table. 1

| Abbreviation | Speaker Mapping |
|---|---|
| L | Front Left |
| R | Front Right |
| C | Front Center |
| Ls | Left Surround |
| Rs | Right Surround |
| Lrs | Left Rear |
| Rrs | Right Rear |
| Cs | Center Back |
| Lvh | Left High Front |
| Rvh | Right High Front |
| LFE | Low-Frequency-Effect |

FIG. 4

Table 1:height_extension_element syntax

| Syntax | No of Bits | Mnemonic |
|---|---|---|
| height_extension_element(comment_field_bytes){ | | |
| bit_counter=0; | | |
| comment_field_bits=comment_field_bytes*8 | | |
| while(nextbits()!=PCE_HEIGHT_EXTENSION_SYNC)&&( bit_counter<comment_field_bits){ | | |
| null_byte; | 8 | bslfb |
| bit_counter+=8; | | |
| } | | |
| if(nextbits()!=PCE_HEIGHT_EXTENSION_SYNC){ | | |
| return ERROR; /* Indicates no data for PCE_HEIGHT_EXTENSION_SYNC */ | | |
| } | | |
| if(bit_counter+8<=comment_field_bits){ | | |
| PCE_HEIGHT_EXTENSION_SYNC; | 8 | bslfb |
| bit_counter+=8; | | |
| }else{ | | |
| return ERROR; /* Indicates no data for PCE_HEIGHT_EXTENSION_SYNC */ | | |
| } | | |
| for(i=0;i<num_front_channel_elements;i++){ | | |
| if(bit_counter+2<=comment_field_bits){ | | |
| front_element_height_info[i]; | 2 | bslfb |
| bit_counter+=2; | | |
| }else | | |
| return ERROR; /*Indicates no data for front_element_height_info*/ | | |
| } | | |
| } | | |
| for(i=0;i<num_side_channel_elements;i++){ | | |
| if(bit_counter+2<=comment_field_bits){ | | |
| side_element_height_info[i]; | 2 | bslfb |
| bit_counter+=2; | | |
| }else | | |
| return ERROR; /*Indicates no data for side_element_height_info*/ | | |
| } | | |
| } | | |
| for(i=0;i<num_back_channel_elements;i++){ | | |
| if(bit_counter+2<=comment_field_bits){ | | |
| back_element_height_info[i]; | 2 | bslfb |
| bit_counter+=2; | | |
| }else | | |
| return ERROR; /*Indicates no data for back_element_height_info*/ | | |
| } | | |
| } | | |
| byte_alignment(); | | |
| height_info_crc_check | 8 | rpchof |
| if(crc_calc()!=height_info_crc_check){ | | |
| return ERROR; /*indicates crc errr*/ | | |
| } | | |
| } | | |

FIG. 5

Table 1a:Height Information

| front_element_height_info<br>side_element_height_info<br>back_element_height_info | height info |
|---|---|
| 0 | Normal height |
| 1 | Top speaker |
| 2 | Bottom Speaker |
| 3 | reserved |

If no Height Extension Element is transmitted height info si set to"Normal Height."

FIG. 6

Table 2:MPEG4 ancillary data syntax

| Syntax | No. of Bits | Mnemonic |
|---|---|---|
| MPEG4 ancillary_data(){ | | |
| ancillary_data_sync; | 8 | bslfb |
| bs_info(); | | |
| ancillary_data_status(); | | |
| If(downmixing_levels_MPEG4_status==1) | | |
| downmixing_levels_MPEG4(); | | |
| If(audio_coding_mode_and_compression_status==1){ | | |
| audio_coding_mode(); | | |
| Compression_value; | 8 | bslfb |
| } | | |
| if(coarse_grain_timecode_status==1) | | |
| coarse_grain_timecode; | 16 | bslfb |
| if(fine_grain_timecode_status==1) | | |
| fine_grain_timecode; | 16 | bslfb |
| If(ancillary_data_extension_status==1) | | |
| MPEG4_ext_ancillary_data(); | | |
| } | | |

FIG. 7

Table 3:bs_info syntax

| Syntax | No. of Bits | Mnemonic |
|---|---|---|
| bs_info() { | | |
| mpeg_audio_type; | 2 | bslfb |
| dolby_surround_mode; | 2 | bslfb |
| drc_presentation_mode; | 2 | bslfb |
| pseudo_surround_enable; | 1 | bslfb |
| reserved, set to"0" | 1 | bslfb |
| } | | |

FIG. 8

Table 4:Ancillary_data_status syntax

| Syntax | No. of Bits | Mnemonic |
|---|---|---|
| ancillary_data_status(){ | | |
| Reserved, set to"0" | 1 | bslfb |
| Reserved, set to"0" | 1 | bslfb |
| Reserved, set to"0" | 1 | bslfb |
| downmixing_levels_MPEG4_status; | 1 | bslfb |
| ancillary_data_extension_status; | 1 | bslfb |
| audio_coding_mode_and_compression_status; | 1 | bslfb |
| coarse_grain_timecode_status; | 1 | bslfb |
| fine_grain_timecode_status; | 1 | bslfb |
| } | | |

FIG. 9

Table 5:Downmixing_levels_MPEG4 syntax

| Syntax | No. of Bits | Mnemonic |
|---|---|---|
| downmixing_levels_MPEG4() { | | |
| center_mix_level_on; | 1 | bslfb |
| center_mix_level_value; | 3 | bslfb |
| surround_mix_level_on; | 1 | bslfb |
| surround_mix_level_value; | 3 | bslfb |
| } | | |

FIG. 10

Table 6:Audio coding mode syntax

| Syntax | No. of Bits | Mnemonic |
|---|---|---|
| audio_coding_mode() { | | |
| reserved, set to"000 0000" | 7 | bslfb |
| compression_on; | 1 | bslfb |
| } | | |

FIG. 11

Table 7:MPEG4_ext_ancillary_data syntax

| Syntax | No. of Bits | Mnemonic |
|---|---|---|
| MPEG4_ext_ancillary_data(){ | | |
| ext_ancillary_data_status(); | | |
| If(ext_downmixing_levels_status==1) | | |
| ext_downmixing_levels(); | | |
| If(ext_downmixing_global_gains_status==1) | | |
| ext_downmixing_global_gains(); | | |
| If(ext_downmixing_lfe_level_status==1) | | |
| ext_downmixing_lfe_level(); | | |
| } | | |

FIG. 12

Table 8:ext_ancillary_data_status syntax

| Syntax | No. of Bits | Mnemonic |
|---|---|---|
| ext_ancillary_data_status() { | | |
| reserved, set to"0" | 1 | bslfb |
| ext_downmixing_levels_status; | 1 | bslfb |
| ext_downmixing_global_gains_status; | 1 | bslfb |
| ext_downmixing_lfe_level_status; | 1 | |
| reserved, set to"0000" | 4 | bslfb |
| } | | |

FIG. 13

Table 9:ext_downmixing_levels syntax

| Syntax | No. of Bits | Mnemonic |
|---|---|---|
| ext_downmixing_levels(){ | | |
| dmix_a_idx; | 3 | bslfb |
| dmix_b_idx; | 3 | bslfb |
| reserved, set to"00" | 2 | bslfb |
| } | | |

FIG. 14

| Chanel configuration | dmix_a_idx | dmix_b_idx |
|---|---|---|
| 7.1 front | surround | center |
| 7.1 surround & rear,6.1 | surround | rear |
| 7.1 height | surround | height |
| } | | |

FIG. 15

Table 11:ext_downmixing_global_gains syntax

| Syntax | No. of Bits | Mnemonic |
|---|---|---|
| ext_downmixing_global_gains() { | | |
| dmx_gain_5_sign; | 1 | bslfb |
| dmx_gain_5_idx; | 6 | bslfb |
| reserved, set to"0" | 1 | bslfb |
| dmx_gain_2_sign; | 1 | bslfb |
| dmx_gain_2_idx; | 6 | bslfb |
| reserved, set to"0" | 1 | bslfb |
| } | | |

FIG. 16

Table 12:ext_downmixing_lfe_level syntax

| Syntax | No. of Bits | Mnemonic |
|---|---|---|
| ext_downmixing_lfe_level() { | | |
| dmix_lfe_idx; | 4 | bslfb |
| reserved, set to"0000" | 4 | bslfb |
| } | | |

FIG. 17

Table 2a:Downmix procedure

| pseudo_surround_enable | Downmix procedre |
|---|---|
| 0 | Lo/Ro |
| 1 | Lt/Rt |

FIG. 18

Table 13:Mix level value table

| dmix_lfe_idx | Multiplication factor |
|---|---|
| 0000 | 3.162(+10dB) |
| 0001 | 2.000(+6dB) |
| 0010 | 1.679(+4.5dB) |
| 0011 | 1.413(+3dB) |
| 0100 | 1.189(+1.5dB) |
| 0101 | 1.0(0dB) |
| 0110 | 0.841(-1.5dB) |
| 0111 | 0.707(-3dB) |
| 1000 | 0.596(-4.5dB) |
| 1001 | 0.500(-6dB) |
| 1010 | 0.316(-10dB) |
| 1011 | 0.178(-15dB) |
| 1100 | 0.100(-20dB) |
| 1101 | 0.032(-30dB) |
| 1110 | 0.010(-40dB) |
| 1111 | 0.000(-∞dB) |

FIG. 19

Table 15:Mix level value table

| dmix_a_idx<br>dmix_b_idx<br>center_mix_level_value<br>surround_mix_level_value | Multiplication factor |
|---|---|
| 0 | 1.0(0dB) |
| 1 | 0.841(-1.5dB) |
| 2 | 0.707(-3dB) |
| 3 | 0.596(-4.5dB) |
| 4 | 0.500(-6dB) |
| 5 | 0.422(-7.5dB) |
| 6 | 0.355(-9dB) |
| 7 | 0.000(-∞dB) |

FIG. 20

Table 16:drc_presentation_mode

| drc_presentation_mode | Description |
|---|---|
| "00" | DRC presentation mode not indicated |
| "01 | DRC presentation mode 1 |
| "10" | DRC presentation mode 2 |
| "11" | Reserved |

FIG. 21

| | | Playback corresponding to a target level of-31 dB | | Playback corresponding to a target level of-23 dB | | |
|---|---|---|---|---|---|---|
| | Channels of playback system | 5.1 | 2.0 | 5.1 | 2.0 | 1.0 |
| DRC presentation mode 1 | 2-channel Stereo Audio content | Not specifed | ISO DRC (scaling allowed) or Compression_value | Not specified | Compression _value | Compression _value |
| | Multichannel Audio content | ISO DRC (scaling allowed) or Compression_value | ISO DRC (scaling restricted) or Compression_value | Compression _value | Compression _value | Compression _value |
| DRC presentation mode 2 | 2-channal Stereo Audio content | Not specified | ISO DRC (scaling allowed) | Not specified | ISO DRC (scaling restricted) | Compression _value |
| | Multichannel Audio content | ISO DRC (scaling allowed) | ISO DRC (scaling restricted) | ISO DRC (scaling restricted) | ISO DRC (scaling restricted) | Compression _value |

NOTES:

1. ISO DRC (scaling allowed):

Dynamic range control data according to ISO/IEC 14496-3 [ERROR! NO REFERENCE SOURCE IS FOUND.] shall be applied. Scaling of both positive and negative gain words (ctrl 1 and ctrl 2 as of chapter 4. 5. 2. 7. 2 of ISO/IEC 14496-3 [ERROR! NO REFERENCE SOURCE IS FOUND.]) is allowed.

2. ISO DRC (scaling restricted):

Dynamic range control data according to ISO/IEC 14496-3 [ERROR! NO REFERENCE SOURCE IS FOUND.] shall be applied. Scaling of negative gain words (ctrl 1 as of chapter 4. 5. 2. 7. 2 of ISO/IEC 14496-3 [ERROR! NO REFERENCE SOURCE IS FOUND.]) is not permitted (i.e. ctrl 1 has to be equal to 1). Scaling of positive gain words s still possible.

3. Compression_value:

If dynamic range control data according to ERROR! NO REFERENCE SOURCE IS FOUND. are present, these values shall be applied without any scaling. Appliance of dynamic range control data according to ISO/IEC 14496-3 [ERROR! NO REFERENCE SOURCE IS FOUND.] is only permitted if dynamic range control data according to ERROR! NO REFERENCE SOURCE IS FOUND. are not present.

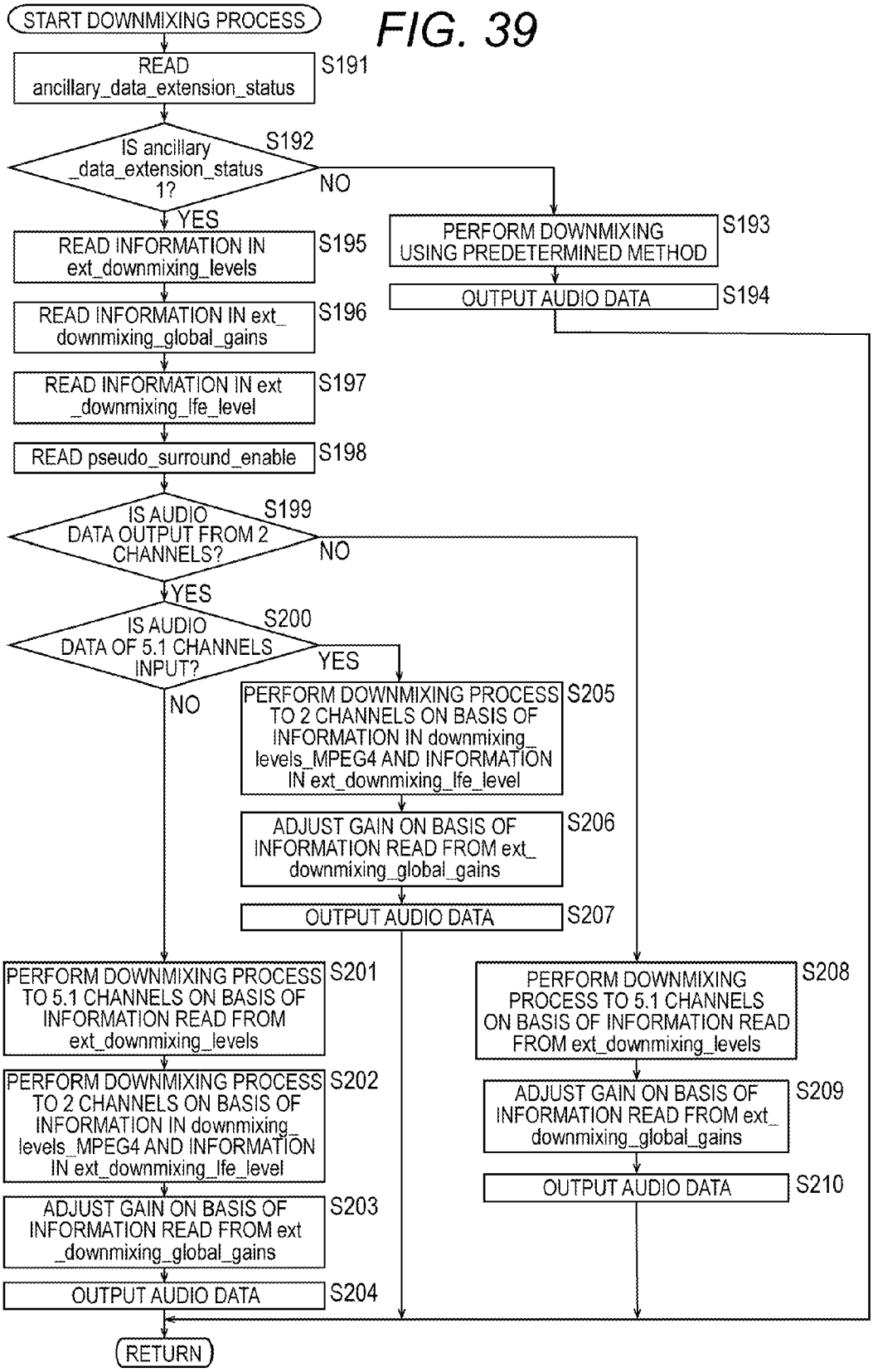
FIG. 39
START DOWNMIXING PROCESS
READ ancillary_data_extension_status
S191
IS ancillary _data_extension_status 1?
S192
NO
YES
PERFORM DOWNMIXING USING PREDETERMINED METHOD
S193
OUTPUT AUDIO DATA
S194
READ INFORMATION IN ext_downmixing_levels
S195
READ INFORMATION IN ext_ downmixing_global_gains
S196
READ INFORMATION IN ext _downmixing_lfe_level
S197
READ pseudo_surround_enable
S198
IS AUDIO DATA OUTPUT FROM 2 CHANNELS?
S199
NO
YES
IS AUDIO DATA OF 5.1 CHANNELS INPUT?
S200
YES
NO
PERFORM DOWNMIXING PROCESS TO 2 CHANNELS ON BASIS OF INFORMATION IN downmixing_ levels_MPEG4 AND INFORMATION IN ext_downmixing_lfe_level
S205
ADJUST GAIN ON BASIS OF INFORMATION READ FROM ext_ downmixing_global_gains
S206
OUTPUT AUDIO DATA
S207
PERFORM DOWNMIXING PROCESS TO 5.1 CHANNELS ON BASIS OF INFORMATION READ FROM ext_downmixing_levels
S201
PERFORM DOWNMIXING PROCESS TO 2 CHANNELS ON BASIS OF INFORMATION IN downmixing_ levels_MPEG4 AND INFORMATION IN ext_downmixing_lfe_level
S202
ADJUST GAIN ON BASIS OF INFORMATION READ FROM ext _downmixing_global_gains
S203
OUTPUT AUDIO DATA
S204
PERFORM DOWNMIXING PROCESS TO 5.1 CHANNELS ON BASIS OF INFORMATION READ FROM ext_downmixing_levels
S208
ADJUST GAIN ON BASIS OF INFORMATION READ FROM ext_ downmixing_global_gains
S209
OUTPUT AUDIO DATA
S210
RETURN

DECODING DEVICE, DECODING METHOD, ENCODING DEVICE, ENCODING METHOD, AND PROGRAM

TECHNICAL FIELD

The present technique relates to a decoding device, a decoding method, an encoding device, an encoding method, and a program, and more particularly, to a decoding device, a decoding method, an encoding device, an encoding method, and a program which can obtain a high-quality realistic sound.

BACKGROUND ART

In recent years, all of the countries of the world have introduced a moving picture distribution service, digital television broadcasting, and the next-generation archiving. In addition to stereophonic broadcasting according to the related art, sound broadcasting corresponding to multiple channels, such as 5.1 channels, starts to be introduced.

In order to further improve image quality, the next-generation high-definition television with a larger number of pixels has been examined. With the examination of the next-generation high-definition television, channels are expected to be extended to multiple channels more than 5.1channels in the horizontal direction and the vertical direction in a sound processing field, in order to achieve a realistic sound.

As a technique related to the encoding of audio data, a technique has been proposed which groups a plurality of windows from different channels into some tiles to improve encoding efficiency (for example, see Patent Document 1).

CITATION LIST

Patent Documents

Patent Document 1: JP 2010-217900 A

SUMMARY OF THE INVENTION

Problems to be Solved by the Invention

However, in the above-mentioned technique, it is difficult to obtain a high-quality realistic sound.

For example, in multi-channel encoding based on the Moving Picture Experts Group-2 Advanced Audio Coding (MPEG-2AAC) standard and the MPEG-4AAC standard, which are the international standards, only the arrangement of speakers in the horizontal direction and information about downmixing from 5.1 channels to stereo channels are defined. Therefore, it is difficult to sufficiently respond to the extension of channels in the plane and the vertical direction.

The present technique has been made in view of the above-mentioned problems and can obtain a high-quality realistic sound.

Solutions to Problems

A decoding device according a first aspect of the present technique includes a decoding unit that decodes audio data included in an encoded bit stream, a reading unit that reads sound source position information about a height of a sound source of the audio data from a region which can store arbitrary data of the encoded bit stream, and an output unit that outputs the decoded audio data on the basis of the sound source position information.

The sound source position information can be information indicating that the height of the sound source is substantially equal to the height of the user, is greater than the height of the user, or is less than the height of the user.

Identification information for identifying whether the sound source position information is present is made to be stored in the region which can store the arbitrary data, and the reading unit may read the sound source position information on the basis of the identification information.

First predetermined identification information and second identification information which is calculated on the basis of the sound source position information may be stored as the identification information in the region which can store the arbitrary data.

The reading unit may determine that the sound source position information is valid when the first identification information included in the region which can store the arbitrary data is predetermined specific information and the second identification information read from the region which can store the arbitrary data is identical to the second identification information which is calculated on the basis of the read sound source position information.

The second identification information may be calculated on the basis of information obtained by performing byte alignment for information including the sound source position information.

A decoding method or a program according to the first aspect of the present technique includes a step of decoding audio data included in an encoded bit stream, a step of reading sound source position information about a height of a sound source of the audio data from a region which can store arbitrary data of the encoded bit stream, and a step of outputting the decoded audio data on the basis of the sound source position information.

In the first aspect of the present technique, the audio data included in the encoded bit stream is decoded, the sound source position information about the height of the sound source of the audio data is read from the region which can store arbitrary data of the encoded bit stream, and the decoded audio data is output on the basis of the sound source position information.

An encoding device according to a second aspect of the present technique includes an acquisition unit that acquires sound source position information about a height of a sound source, an encoding unit that encodes audio data and the sound source position information, and a packing unit that stores the encoded sound source position information in a region which can store arbitrary data and generates an encoded bit stream including the encoded audio data and the encoded sound source position information.

The sound source position information can be information indicating that the height of the sound source is substantially equal to the height of the user, is greater than the height of the user, or is less than the height of the user.

The sound source position information and identification information for identifying whether the sound source position information is present may be stored in the region which can store the arbitrary data.

First predetermined identification information and second identification information which is calculated on the basis of the sound source position information may be stored as the identification information in the region which can store the arbitrary data.

Information for instructing the execution of byte alignment for information including the sound source position information and information for instructing comparison between the second identification information which is calculated on the basis of information obtained by the byte alignment and the second identification information stored in the region which can store the arbitrary data may be further stored in the region which can store the arbitrary data.

An encoding method or a program according to the second aspect of the present technique includes a step of acquiring sound source position information about a height of a sound source, a step of encoding audio data and the sound source position information, and a step of storing the encoded sound source position information in a region which can store arbitrary data and generating an encoded bit stream including the encoded audio data and the encoded sound source position information.

In the second aspect according to the present technique, the sound source position information about the height of the sound source is acquired. Audio data and the sound source position information are encoded. The encoded sound source position information is stored in the region which can store arbitrary data and the encoded bit stream including the encoded audio data and the encoded sound source position information is generated.

Effects of the Invention

According to the first and second aspects of the present technique, it is possible to obtain a high-quality realistic sound.

BRIEF DESCRIPTION OF DRAWINGS

FIG. 2 is a diagram illustrating an example of speaker mapping.

FIG. 4 is a diagram illustrating the syntax of height_extension_element.

FIG. 5 is a diagram illustrating the arrangement height of the speakers.

FIG. 6 is a diagram illustrating the syntax of MPEG4 ancillary data.

FIG. 7 is a diagram illustrating the syntax of bs_info( )

FIG. 8 is a diagram illustrating the syntax of ancillary_data_status( ).

FIG. 9 is a diagram illustrating the syntax of downmixing_levels_MPEG4( ).

FIG. 10 is a diagram illustrating the syntax of audio_coding_mode( ).

FIG. 11 is a diagram illustrating the syntax of MPEG4_ext_ancillary_data( ).

FIG. 12 is a diagram illustrating the syntax of ext_ancillary_data_status( ).

FIG. 13 is a diagram illustrating the syntax of ext_downmixing_levels( ).

FIG. 14 is a diagram illustrating targets to which each coefficient is applied.

FIG. 15 is a diagram illustrating the syntax of ext_downmixing_global_gains( ).

FIG. 16 is a diagram illustrating the syntax of ext_downmixing_lfe_level( ).

FIG. 17 is a diagram illustrating downmixing.

FIG. 18 is a diagram illustrating a coefficient which is determined for dmix_lfe_idx.

FIG. 19 is a diagram illustrating coefficients which are determined for dmix_a_idx and dmix_b_idx.

FIG. 20 is a diagram illustrating the syntax of drc_presentation_mode.

FIG. 21 is a diagram illustrating drc_presentation_mode.

FIG. 39 is a flowchart illustrating a downmixing process.

MODES FOR CARRYING OUT THE INVENTION

Hereinafter, embodiments to which the present technique is applied will be described with reference to the drawings.

First Embodiment

[For Outline of the Present Technique]

First, the outline of the present technique will be described.

The present technique relates to the encoding and decoding of audio data. For example, in multi-channel encoding based on an MPEG-2AAC or MPEG-4AAC standard, it is difficult to obtain information for channel extension in the horizontal plane and the vertical direction.

In the multi-channel encoding, there is no downmixing information of channel-extended content and the appropriate mixing ratio of channels is not known. Therefore, it is difficult for a portable apparatus with a small number of reproduction channels to reproduce a sound.

The present technique can obtain a high-quality realistic sound using the following characteristics (1) to (4).

(1) Information about the arrangement of speakers in the vertical direction is recorded in a comment region in PCE (Program_config_element) defined by the existing AAC standard.

(2) In the case of the characteristic (1), in order to distinguish public comments from the speaker arrangement information in the vertical direction, an encoding device encodes two identification information items, that is, a synchronous word and a CRC check code and a decoding device compares the two identification information items. When the two identification information items are identical to each other, the decoding device acquires the speaker arrangement information.

(3) The downmixing information of audio data is recorded in an ancillary data region (DSE (data_stream_element)).

(4) Downmixing from 6.1 channels or 7.1 channels to 2 channels is two-stage processing including downmixing from 6.1 channels or 7.1 channels to 5.1 channels and downmixing from 5.1 channels to 2 channels.

As such, the use of the information about the arrangement of the speakers in the vertical direction makes it possible to reproduce a sound image in the vertical direction, in addition to in the plane, and to reproduce a more realistic sound than the planar multiple channels according to the related art.

In addition, when information about downmixing from 6.1 channels or 7.1 channels to 5.1 channels or 2 channels is transmitted, the use of one encoding data item makes it possible to reproduce a sound with the number of channels most suitable for each reproduction environment. In the decoding device according to the related art which does not correspond to the present technique, information in the vertical direction is ignored as the public comments and audio data is decoded. Therefore, compatibility is not damaged.

[For Arrangement of Speakers]

Next, the arrangement of the speakers when audio data is reproduced will be described.

Figure 1:
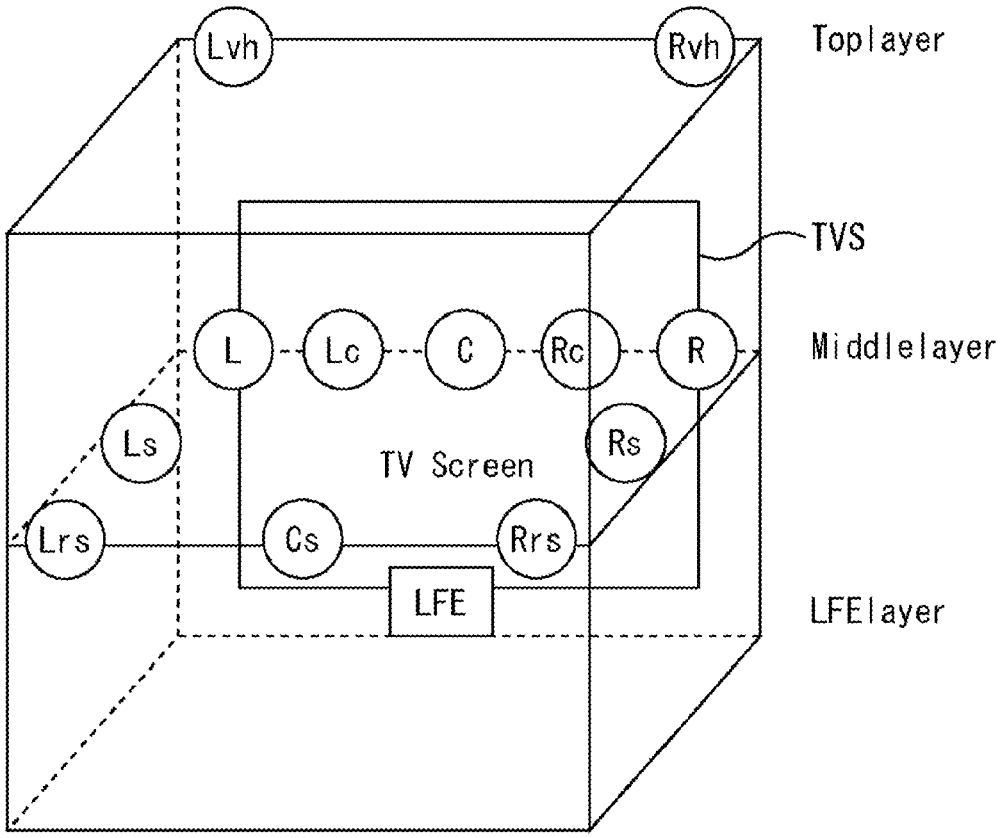
FIG. 1 is a diagram illustrating the arrangement of speakers.

For example, it is assumed that, as illustrated in FIG. 1, the user observes a display screen TVS of a display device, such as a television set, from the front side. That is, it is assumed that the user is disposed in front of the display screen TVS in FIG. 1.

In this case, it is assumed that 13 speakers Lvh, Rvh, Lrs, Ls, L, Lc, C, Rc, R, Rs, Rrs, Cs, and LFE are arranged so as to surround the user.

Hereinafter, the channels of audio data (sounds) reproduced by the speakers Lvh, Rvh, Lrs, Ls, L, Lc, C, Rc, R, Rs, Rrs, Cs, and LFE are referred to as Lvh, Rvh, Lrs, Ls, L, Lc, C, Rc, R, Rs, Rrs, Cs, and LFE, respectively.

As illustrated in FIG. 2, the channel L is "Front Left", the channel R is "Front Right", and the channel C is "Front Center".

In addition, the channel Ls is "Left Surround", the channel Rs is"Right Surround", the channel Lrs is"Left Rear", the channel Rrs is "Right Rear", and the channel Cs is "Center Back".

The channel Lvh is "Left High Front", the channel Rvh is "Right High Front", and the channel LFE is "Low-Frequency-Effect".

Returning to FIG. 1, the speaker Lvh and the speaker Rvh are arranged on the front upper left and right sides of the user. The layer in which the speakers Rvh and Lvh are arranged is a "top layer".

The speakers L, C, and R are arranged on the left, center, and right of the user. The speakers Lc and Rc are arranged between the speakers L and C and between the speakers R and C, respectively. In addition, the speakers Ls and Rs are arranged on the left and right sides of the user, respectively, and the speakers Lrs, Rrs, and Cs are arranged on the rear left, rear right, and rear of the user, respectively.

The speakers Lrs, Ls, L, Lc, C, Rc, R, Rs, Rrs, and Cs are arranged in the plane which is disposed substantially at the height of the ears of the user so as to surround the user. The layer in which the speakers are arranged is a "middle layer".

The speaker LFE is arranged on the front lower side of the user and the layer in which the speaker LFE is arranged is a "LFE layer".

[For Encoded Bit Stream]

Figure 3:
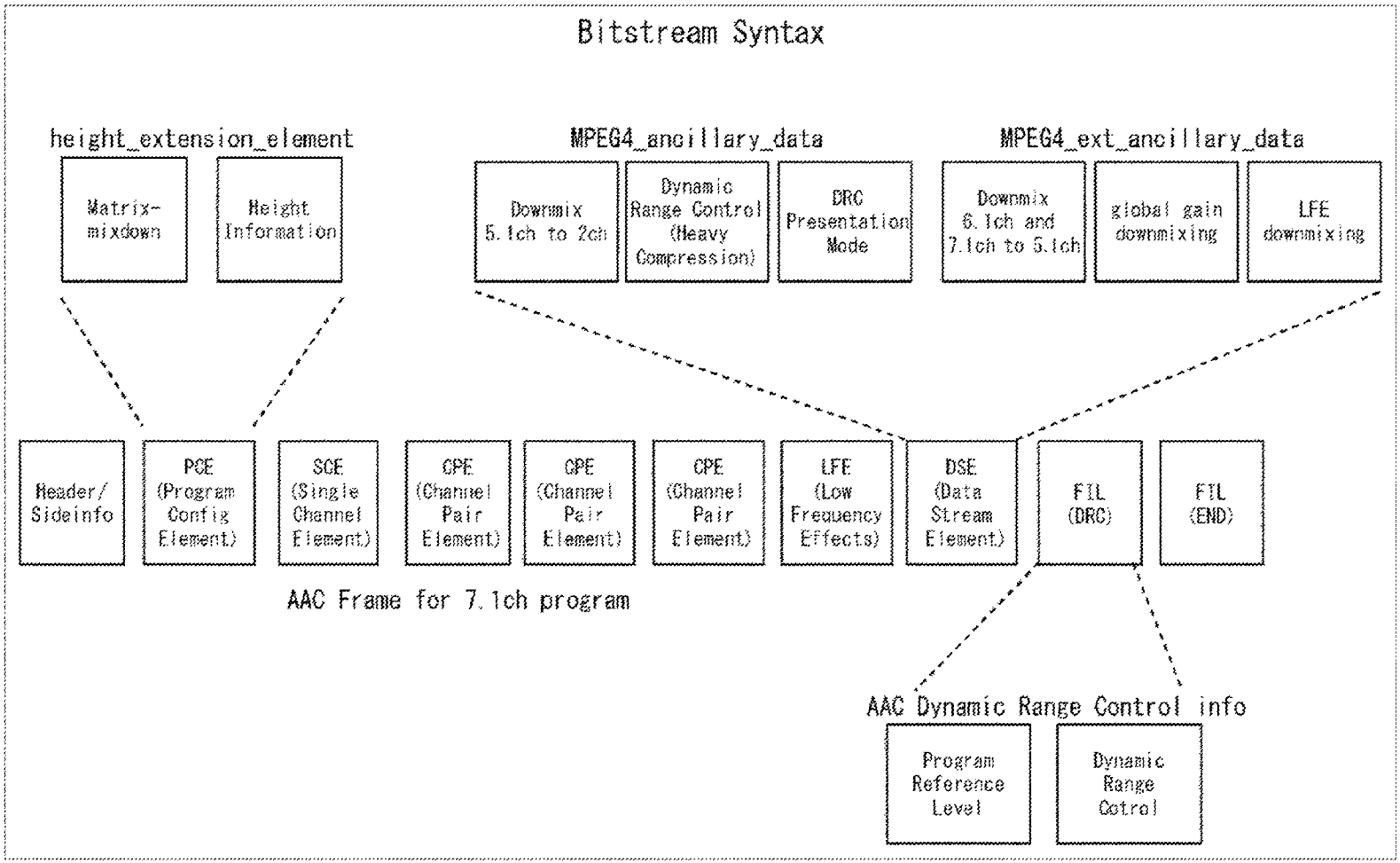
FIG. 3 is a diagram illustrating an encoded bit stream.

When the audio data of each channel is encoded, for example, an encoded bit stream illustrated in FIG. 3 is obtained. That is, FIG. 3 illustrates the syntax of the encoded bit stream of an AAC frame.

The encoded bit stream illustrated in FIG. 3 includes "Header/sideinfo", "PCE", "SCE", "CPE", "LFE", "DSE", "FIL(DRC)", and "FIL(END)". In this example, the encoded bit stream includes three "CPEs".

For example, "PCE" includes information about each channel of audio data. In this example, "PCE" includes "Matrix-mixdown", which is information about the downmixing of audio data, and "Height Infomation", which is information about the arrangement of the speakers. In addition, "PCE" includes "comment_field_data", which is a comment region (comment field) that can store free comments, and "comment_field_data" includes "height_extension_element" which is an extended region. The comment region can store arbitrary data, such as public comments. The "height_extension_element" includes "Height Infomation" which is information about the height of the arrangement of the speakers.

"SCE" includes audio data of a single channel, "CPE" includes audio data of a channel pair, that is, two channels, and "LFE" includes audio data of, for example, the channel LFE. For example, "SCE" stores audio data of the channel C or Cs and "CPE" includes audio data of the channel L or R or the channel Lvh or Rvh.

In addition, "DSE" is an ancillary data region. The "DSE" stores free data. In this example, "DSE" includes, as information about the downmixing of audio data, "Downmix 5.1ch to 2ch", "Dynamic Range Control", "DRC Presentation Mode", "Downmix6.1ch and 7.1ch to 5.1ch", "global gain downmixing", and "LFE downmixing".

In addition, "FIL(DRC)" includes information about the dynamic range control of sounds. For example, "FIL(DRC)" includes "Program Reference Level" and "Dynamic Range Control".

[For Comment Field]

As described above, "comment_field_data" of "PCE" includes "height_extension_element". Therefore, multichannel reproduction is achieved by the information about the arrangement of the speakers in the vertical direction. That is, a high-quality realistic sound is reproduced by the speakers which are arranged in the layer with each height, such as "Top layer" or "Middle layer".

For example, as illustrated in FIG. 4, "height_extension_element" includes the synchronous word for distinguishment from other public comments. That is, FIG. 4 is a diagram illustrating the syntax of "height_extension_element".

In FIG. 4, "PCE_HEIGHT_EXTENSION_SYNC" indicates the synchronous word.

In addition, "front_element_height_info[i]", "side_element_height_info[i]", and "back_element_height_info[i]" indicate the heights of the speakers which are disposed on the front, side, and rear of the viewer, that is, the layers.

Furthermore, "byte_alignment( )" indicates byte alignment and "height_info_crc_check" indicates a CRC check code which is used as identification information. In addition, the CRC check code is calculated on the basis of information which is read between "PCE_HEIGHT_EXTENSION_SYNC" and "byte_alignment( )", that is, the synchronous word, information about the arrangement of each speaker (information about each channel), and the byte alignment. Then, it is determined whether the calculated CRC check code is identical to the CRC check code indicated by "height_info_crc_check". When the CRC check codes are identical to each other, it is determined that the information about the arrangement of each speaker is correctly read. In addition, "crc_cal( )!=height_info_crc_check" indicates the comparison between the CRC check codes.

For example, "front_element_height_info[i]", "side_element_height_info[i]", and "back_element_height_info[i]", which are information about the position of sound sources, that is, the arrangement (height) of the speakers, are set as illustrated in FIG. 5.

That is, when information about "front_element_height_info[i]", "side_element_height_info[i]", and "back_element_height_info[i]" is "0", "1", and "2", the heights of the speakers are "Normal height", "Top speaker", and "Bottom Speaker", respectively. That is, the layers in which the speakers are arranged are "Middle layer", "Top layer", and "LFE layer".

[For DSE]

Next, "MPEG4 ancillary data", which is an ancillary data region included in "DSE", that is, "data_stream_byte[ ]" of '"data_stream_element( )", will be described. Downmixing DRC control for audio data from 6.1 channels or 7.1 channels to 5.1 channels or 2 channels can be performed by "MPEG4 ancillary data".

FIG. 6 is a diagram illustrating the syntax of "MPEG4 ancillary data". The "MPEG4 ancillary data" includes "bs_info( )", "ancillary_data_status( )", "downmixing_levels_MPEG4( )", "audio_coding_mode( )", "Compression_value", and "MPEG4_ext_ancillary_data( )".

Here, "Compression_value" corresponds to "Dynamic Range Control" illustrated in FIG. 3. In addition, the syntax of "bs_info( )", "ancillary_data_status( )", "downmixing_levels_MPEG4( )", "audio_coding_mode( )", and "MPEG4_ext_ancillary_data( )" is as illustrated in FIGS. 7 to 11, respectively.

For example, as illustrated in FIG. 7, "bs_info( )" includes "mpeg_audio_type", "dolby_surround_mode", "drc_presentation_mode", and "pseudo_surround_enable".

In addition, "drc_presentation_mode" corresponds to "DRC Presentation Mode" illustrated in FIG. 3. Furthermore, "pseudo_surround_enable" includes information indicating the procedure of downmixing from 5.1 channels to 2 channels, that is, information indicating one of a plurality of downmixing methods to be used for downmixing.

For example, the process varies depending on whether "ancillary_data_extension_status" included in "ancillary_data_status( )" illustrated in FIG. 8 is 0 or 1. When "ancillary_data_extension_status" is 1, access to "MPEG4_ext_ancillary_data( )" in "MPEG4 ancillary data" illustrated in FIG. 6 is performed and the downmixing DRC control is performed. On the other hand, when "ancillary_data_extension_status" is 0, the process according to the related art is performed. In this way, it is possible to ensure compatibility with the existing standard.

In addition, "downmixing_levels_MPEG4_status" included in "ancillary_data_status( )" illustrated in FIG. 8 is information for designating a coefficient (mixing ratio) which is used to downmix 5.1 channels to 2 channels. That is, when "downmixing_levels_MPEG4_status" is 1, a coefficient which is determined by the information stored in "downmixing_levels_MPEG4( )" illustrated in FIG. 9 is used for downmixing.

Furthermore, "downmixing_levels_MPEG4( )" illustrated in FIG. 9 includes "center_mix_level_value" and "surround_mix_level_value" as information for specifying a downmix coefficient. For example, the values of coefficients corresponding to "center_mix_level_value" and "surround_mix_level_value" are determined by the table illustrated in FIG. 19, which will be described below.

In addition, "downmixing_levels_MPEG4( )" illustrated in FIG. 9 corresponds to "Downmix 5.1ch to 2ch" illustrated in FIG. 3.

Furthermore, "MPEG4_ext_ancillary_data( )" illustrated in FIG. 11 includes "ext_ancillary_data_status( )", "ext_downmixing_levels( )", "ext_downmixing_global_gains( )", and "ext_downmixing_lfe_level( )".

Information required to extend the number of channels such that audio data of 5.1 channels is extended to audio data of 7.1 channels or 6.1 channels is stored in "MPEG4_ext_ancillary_data( )".

Specifically, "ext_ancillary_data_status( )" includes information (flag) indicating whether to downmix channels greater than 5.1 channels to 5.1 channels, information indicating whether to perform gain control during downmixing, and information indicating whether to use LFE channel during downmixing.

Information for specifying a coefficient (mixing ratio) used during downmixing is stored in "ext_downmixing_levels( )" and information related to the gain during gain adjustment is included in "ext_downmixing_global_gains( )". In addition, information for specifying a coefficient (mixing ratio) of the LEF channel used during downmixing is stored in "ext_downmixing_lfe_level( )".

Specifically, for example, the syntax of "ext_ancillary_data_status( )" is as illustrated in FIG. 12. In "ext_ancillary_data_status( )", "ext_downmixing_levels_status" indicates whether to downmix 6.1 channels or 7.1 channels to 5.1 channels. That is, "ext_downmixing_levels_status" indicates whether "ext_downmixing_levels( )" is present. The "ext_downmixing_levels_status" corresponds to "Downmix 6.1ch and 7.1ch to 5.1ch" illustrated in FIG. 3.

In addition, "ext_downmixing_global_gains_status" indicates whether to perform global gain control and corresponds to "global gain downmixing" illustrated in FIG. 3. That is, "ext_downmixing_global_gains_status" indicates whether "ext_downmixing_global_gains( )" is present. In addition, "ext_downmixing_lfe_level_status" indicates whether the LFE channel is used when 5.1 channels are downmixed to 2 channels and corresponds to "LFE downmixing" illustrated in FIG. 3.

The syntax of "ext_downmixing_levels( )" in "MPEG4_ext_ancillary_data( )" illustrated in FIG. 11 is as illustrated in FIG. 13 and "dmix_a_idx" and "dmix_b_idx" illustrated in FIG. 13 is information indicating the mixing ratio (coefficient) during downmixing.

FIG. 14 illustrates the correspondence between "dmix_a_idx" and "dmix_b_idx" determined by "ext_downmixing_levels( )" and components to which "dmix_a_idx" and "dmix_b_idx" are applied when audio data of 7.1 channels is downmixed.

The syntax of "ext_downmixing_global_gains( )" and "ext_downmixing_lfe_level( )" in "MPEG4_ext_ancillary_data( )" illustrated in FIG. 11 is as illustrated in FIGS. 15 and 16.

For example, "ext_downmixing_global_gains( )" illustrated in FIG. 15 includes "dmx_gain_5_sign" which indicates the sign of the gain during downmixing to 5.1 channels, the gain "dmx_gain_5_idx", "dmx_gain_2_sign"

which indicates the sign of the gain during downmixing to 2 channels, and the gain "dmx_gain_2_idx".

In addition, "ext_downmixing_lfe_level( )" illustrated in FIG. 16 includes "dmix_lfe_idx", and "dmix_lfe_idx" is information indicating the mixing ratio (coefficient) of the LFE channel during downmixing.

[For Downmixing]

In addition, "pseudo_surround_enable" in the syntax of "bs_info( )" illustrated in FIG. 7 indicates the procedure of a downmixing process and the procedure of the process is as illustrated in FIG. 17. Here, FIG. 17 illustrates two procedures when "pseudo_surround_enable" is 0 and when "pseudo_surround_enable" is 1.

Next, an audio data downmixing process will be described.

First, downmixing from 5.1 channels to 2 channels will be described. In this case, when the L channel and the R channel after downmixing are an L' channel and an R' channel, respectively, the following process is performed.

That is, when "pseudo_surround_enable" is 0, the audio data of the L' channel and the R' channel is calculated by the following Expression (1).

$$L'=L+C\times b+Ls\times a+\mathrm{LFE}\times c$$

$$R'=R+C\times b+Rs\times a+\mathrm{LFE}\times c \quad (1)$$

When "pseudo_surround_enable" is 1, the audio data of the L' channel and the R' channel is calculated by the following Expression (2).

$$L'=L+C\times b-a\times(Ls+Rs)+\mathrm{LFE}\times c$$

$$R'=R+C\times b+a\times(Ls+Rs)+\mathrm{LFE}\times c \quad (2)$$

In Expression (1) and Expression (2), L, R, C, Ls, Rs, and LFE are channels forming 5.1 channels and indicate the channels L, R, C, Ls, Rs, and LFE which have been described with reference to FIGS. 1 and 2, respectively.

In Expression (1) and Expression (2), "c" is a constant which is determined by the value of "dmix_lfe_idx" included in "ext_downmixing_lfe_level( )" illustrated in FIG. 16. For example, the value of the constant c corresponding to each value of "dmix_lfe_idx" is as illustrated in FIG. 18 Specifically, when "ext_downmixing_lfe_level_status" in "ext_ancillary_data_status( )" illustrated in FIG. 12 is 0, the LFE channel is not used in the calculation using Expression (1) and Expression (2). When "ext_downmixing_lfe_level_status" is 1, the value of the constant c multiplied by the LFE channel is determined on the basis of the table illustrated in FIG. 18.

In Expression (1) and Expression (2), "a" and "b" are constants which are determined by the values of "dmix_a_idx" and "dmix_b_idx" included in "ext_downmixing_levels( )" illustrated in FIG. 13. In addition, in Expression (1) and Expression (2), "a" and "b" may be constants which are determined by the values of "center_mix_level_value" and "surround_mix_level_value" in "downmixing_levels_MPEG4( )" illustrated in FIG. 9.

For example, the values of the constants a and b with respect to the values of "dmix_a_idx" and "dmix_b_idx" or the values of "center_mix_level_value" and "surround_mix_level_value" are as illustrated in FIG. 19. In this example, since the same table is referred to by "dmix_a_idx" and "dmix_b_idx", and "center_mix_level_value" and "surround_mix_level_value", the constants (coefficients) a and b for downmixing have the same value.

Then, downmixing from 7.1 channels or 6.1 channels to 5.1 channels will be described.

When the audio data of the channels C, L, R, Ls, Rs, Lrs, Rrs, and LFE including the channels of the speakers Lrs and Rrs which are arranged on the rear of the user is converted into audio data of 5.1 channels including the channels C', L', R', Ls', Rs', and LFE', calculation is performed by the following Expression (3). Here, the channels C', L', R', Ls', Rs', and LFE' indicate channels C, L, R, Ls, Rs, and LFE after downmixing, respectively. In addition, in Expression (3), C, L, R, Ls, Rs, Lrs, Rrs, and LFE indicate the audio data of the channels C, L, R, Ls, Rs, Lrs, Rrs, and LFE.

$$C'=C$$

$$L'=L$$

$$R'=R$$

$$Ls'=Ls\times d1+Lrs\times d2$$

$$Rs'=Rs\times d1+Rrs\times d2$$

$$\mathrm{LFE}'=\mathrm{LFE} \quad (3)$$

In Expression (3), d1 and d2 are constants. For example, the constants d1 and d2 are determined for the values of "dmix_a_idx" and "dmix_b_idx" illustrated in FIG. 19.

When the audio data of the channels C, L, R, Lc, Rc, Ls, Rs, and LFE including the channels of the speakers Lc and Rc which are arranged on the front side of the user is converted into audio data of 5.1 channels including the channels C', L', R', Ls', Rs', and LFE', calculation is performed by the following Expression (4). Here, the channels C', L', R', Ls', Rs', and LFE' indicate channels C, L, R, Ls, Rs, and LFE after downmixing, respectively. In Expression (4), C, L, R, Lc, Rc, Ls, Rs, and LFE indicate the audio data of the channels C, L, R, Lc, Rc, Ls, Rs, and LFE.

$$C'=C+e1\times(Lc+Rc)$$

$$L'=L+Lc\times e2$$

$$R'=R+Rc\times e2$$

$$Ls'=Ls$$

$$Rs'=Rs$$

$$\mathrm{LFE}'=\mathrm{LFE} \quad (4)$$

In Expression (4), e1 and e2 are constants. For example, the constants e1 and e2 are determined for the values of "dmix_a_idx" and "dmix_b_idx" illustrated in FIG. 19.

When the audio data of the channels C, L, R, Lvh, Rvh, Ls, Rs, and LFE including the channels of the speakers Rvh and Lvh which are arranged on the front upper side of the user is converted into audio data of 5.1 channels including the channels C', L', R', Ls', Rs', and LFE', calculation is performed by the following Expression (5). Here, the channels C', L', R', Ls', Rs', and LFE' indicate channels C, L, R, Ls, Rs, and LFE after downmixing, respectively. In Expression (5), C, L, R, Lvh, Rvh, Ls, Rs, and LFE indicate the audio data of the channels C, L, R, Lvh, Rvh, Ls, Rs, and LFE.

$$C'=C$$

$$L'=L\times f1+Lvh\times f2$$

$$R'=R\times f1+Rvh\times f2$$

$$Ls'=Ls$$

$$Rs'=Rs$$

$$\mathrm{LFE}'=\mathrm{LFE} \quad (5)$$

In Expression (5), f1 and f2 are constants. For example, the constants f1 and f2 are determined for the values of "dmix_a_idx" and "dmix_b_idx" illustrated in FIG. 19.

When downmixing from 6.1 channels to 5.1 channels is performed, the following process is performed. That is, when the audio data of the channels C, L, R, Ls, Rs, Cs, and LFE is converted into audio data of 5.1 channels including the channels C', L', R', Ls', Rs', and LFE', calculation is performed by the following Expression (6). Here, the channels C', L', R', Ls', Rs', and LFE' indicate channels C, L, R, Ls, Rs, and LFE after downmixing, respectively. In Expression (6), C, L, R, Ls, Rs, Cs, and LFE indicate the audio data of the channels C, L, R, Ls, Rs, Cs, and LFE.

$$C'=C$$

$$L'=L$$

$$R'=R$$

$$Ls'=Ls\times g1+Cs\times g2$$

$$Rs'=Rs\times g1+Cs\times g2$$

$$\text{LFE'}=\text{LFE} \tag{6}$$

In Expression (6), g1 and g2 are constants. For example, the constants g1 and g2 are determined for the values of "dmix_a_idx" and "dmix_b_idx" illustrated in FIG. 19.

Next, a global gain for volume correction during downmixing will be described.

The global downmix gain is used to correct the sound volume which is increased or decreased by downmixing. Here, dmx_gain5 indicates a correction value for downmixing from 7.1 channels or 6.1 channels to 5.1 channels and dmx_gain2 indicates a correction value for downmixing from 5.1 channels to 2 channels. In addition, dmx_gain2 supports a decoding device or a bit stream which does not correspond to 7.1 channels.

The application and operation thereof are similar to DRC heavy compression. In addition, the encoding device may appropriately perform selective evaluation for the period for which the audio frame is long or the period for which the audio frame is too short to determine the global downmix gain.

During downmixing from 7.1 channels to 2 channels, the combined gain, that is, (dmx_gain5+dmx_gain2) is applied. For example, a 6-bit unsigned integer is used as dmx_gain5 and dmx_gain2, and dmx_gain5 and dmx_gain2 are quantized at an interval of 0.25 dB.

Therefore, when dmx_gain5 and dmx_gain2 are combined with each other, the combined gain is in the range of ±15.75 dB. The gain value is applied to a sample of the audio data of the decoded current frame.

Specifically, during downmixing to 5.1 channels, the following process is performed. That is, when gain correction is performed for the audio data of the channels C', L', R', Ls', Rs', and LFE' obtained by downmixing to obtain audio data of channels C", L", R", Ls", Rs", and LFE", calculation is performed by the following Expression (7).

$$L''=L'\times\text{dmx_gain5}$$

$$R''=R'\times\text{dmx_gain5}$$

$$C''=C'\times\text{dmx_gain5}$$

$$Ls''=Ls'\times\text{dmx_gain5}$$

$$Rs''=Rs'\times\text{dmx_gain5}$$

$$\text{LFE''}=\text{LFE'}\times\text{dmx_gain5} \tag{7}$$

Here, dmx_gain5 is a scalar value and is a gain value which is calculated from "dmx_gain_5_sign" and "dmx_gain_5_idx" illustrated in FIG. 15 by the following Expression (8).

$$\text{dmx_gain5}=10^{(dmx_gain_5_idx/20)} \text{ if } \text{dmx_gain_5_sign}==1$$

$$\text{dmx_gain5}=10^{(-dmx_gain_5_idx/20)} \text{ if } \text{dmx_gain_5_sign}==0 \tag{8}$$

Similarly, during downmixing to 2 channels, the following process is performed. That is, when gain correction is performed for the audio data of the channels L' and R' obtained by downmixing to obtain audio data of channels L" and R", calculation is performed by the following Expression (9).

$$L''=L'\times\text{dmx_gain2}$$

$$R''=R'\times\text{dmx_gain2} \tag{9}$$

Here, dmx_gain2 is a scalar value and is a gain value which is calculated from "dmx_gain_2_sign" and "dmx_gain_2_idx" illustrated in FIG. 15 by the following Expression (10).

$$\text{dmx_gain2}=10^{(dmx_gain_2_idx/20)} \text{ if } \text{dmx_gain_2_sign}==1$$

$$\text{dmx_gain2}=10^{(-dmx_gain_2_idx/20)} \text{ if } \text{dmx_gain_2_sign}==0 \tag{10}$$

During downmixing from 7.1 channels to 2 channels, after 7.1 channels are downmixed to 5.1 channels and 5.1 channels are downmixed to 2 channels, gain adjustment may be performed for the obtained signal (data). In this case, a gain value dmx_gain_7to2 applied to audio data can be obtained by combining dmx_gain5 and dmx_gain2, as described in the following Expression (11).

$$\text{dmx_gain_7to2}=\text{dmx_gain_2}\times\text{dmx_gain_5} \tag{11}$$

Downmixing from 6.1 channels to 2 channels is performed, similarly to the downmixing from 7.1 channels to 2 channels.

For example, during downmixing from 7.1 channels to 2 channels, when gain correction is performed in two stages by Expression (7) or Expression (9), it is possible to output the audio data of 5.1 channels and the audio data of 2 channels.

[For DRC Presentation Mode]

In addition, "drc_presentation_mode" included in "bs_info( )" illustrated in FIG. 7 is as illustrated in FIG. 20. That is, FIG. 20 is a diagram illustrating the syntax of "drc_presentation_mode".

When "drc_presentation_mode" is "01", the mode is "DRC presentation mode 1". When "drc_presentation_mode" is "10", the mode is "DRC presentation mode 2". In "DRC presentation mode 1" and "DRC presentation mode 2", gain control is performed as illustrated in FIG. 21.

[Example Structure of an Encoding Device]

Next, the specific embodiments to which the present technique is applied will be described.

Figure 22:
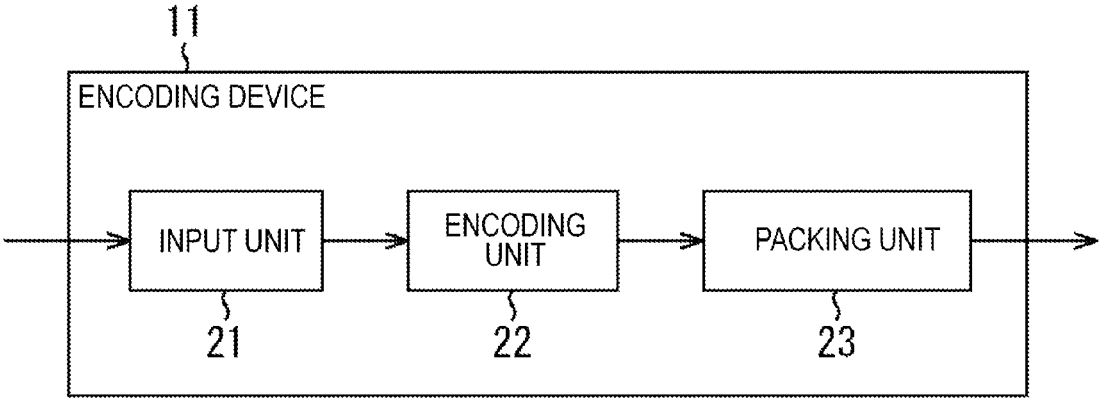
FIG. 22 is a diagram illustrating an example of the structure of an encoding device.

FIG. 22 is a diagram illustrating an example of the structure of an encoding device according to an embodiment to which the present technique is applied. An encoding device 11 includes an input unit 21, an encoding unit 22, and a packing unit 23.

The input unit 21 acquires audio data and information about the audio data from the outside and supplies the audio data and the information to the encoding unit 22. For example, information about the arrangement (arrangement height) of the speakers is acquired as the information about the audio data.

The encoding unit 22 encodes the audio data and the information about the audio data supplied from the input unit 21 and supplies the encoded audio data and information to the packing unit 23. The packing unit 23 packs the audio data or the information about the audio data supplied from the encoding unit 22 to generate an encoded bit stream illustrated in FIG. 3 and outputs the encoded bit stream.

[Description of Encoding Process]

Figure 23:
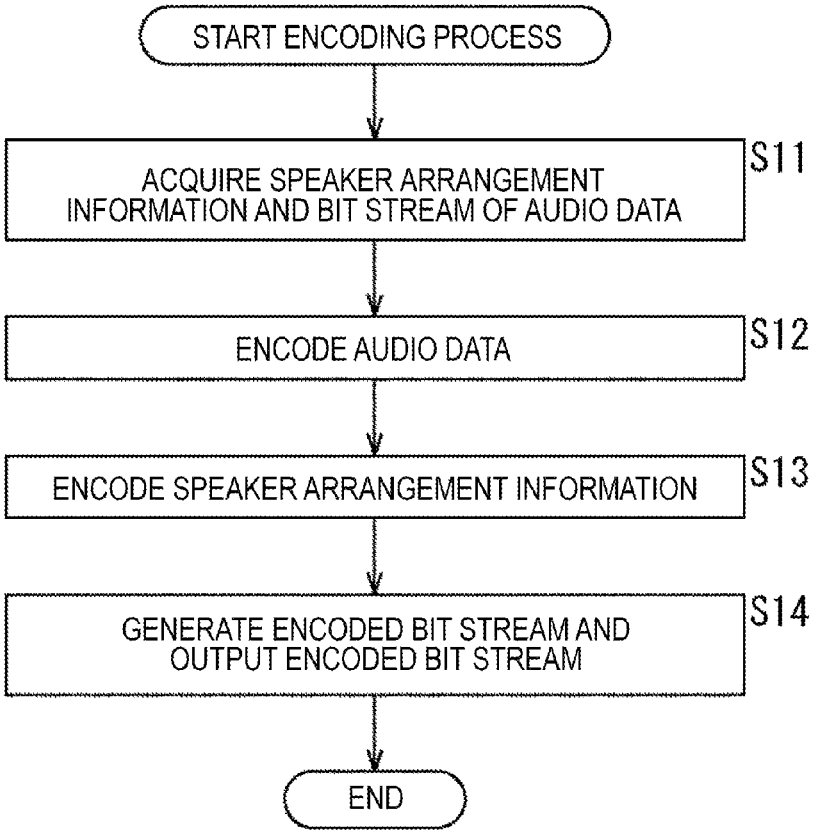
FIG. 23 is a flowchart illustrating an encoding process.

Next, an encoding process of the encoding device 11 will be described with reference to the flowchart illustrated in FIG. 23.

In Step S11, the input unit 21 acquires audio data and information about the audio data and supplies the audio data and the information to the encoding unit 22. For example, the audio data of each channel among 7.1 channels and information (hereinafter, referred to as speaker arrangement information) about the arrangement of the speakers which is to be stored in "height_extension_element" illustrated in FIG. 4 are acquired.

In Step S12, the encoding unit 22 encodes the audio data of each channel supplied from the input unit 21.

In Step S13, the encoding unit 22 encodes the speaker arrangement information supplied from the input unit 21. In this case, the encoding unit 22 generates the synchronous word which is to be stored in "PCE_HEIGHT_EXTENSION_SYNC" included in "height_extension_element" illustrated in FIG. 4 or the CRC check code, which is identification information which is to be stored in "height_info_crc_check", and supplies the synchronous word or the CRC check code and the encoded speaker arrangement information to the packing unit 23.

In addition, the encoding unit 22 generates information required to generate the encoded bit stream and supplies the generated information and the encoded audio data or the speaker arrangement information to the packing unit 23.

In Step S14, the packing unit 23 performs bit packing for the audio data or the speaker arrangement information supplied from the encoding unit 22 to generate the encoded bit stream illustrated in FIG. 3. In this case, the packing unit 23 stores, for example, the speaker arrangement information or the synchronous word and the CRC check code in "PCE" and stores the audio data in "SCE" or "CPE".

When the encoded bit stream is output, the encoding process ends.

In this way, the encoding device 11 inserts the speaker arrangement information, which is information about the arrangement of the speakers in each layer, into the encoded bit stream and outputs the encoded audio data. As such, when the information about the arrangement of the speakers in the vertical direction is used, it is possible to reproduce a sound image in the vertical direction, in addition to in the plane. Therefore, it is possible to reproduce a more realistic sound.

[Example Structure of a Decoding Device]

Next, a decoding device which receives the encoded bit stream output from the encoding device 11 and decodes the encoded bit stream will be described.

Figure 24:
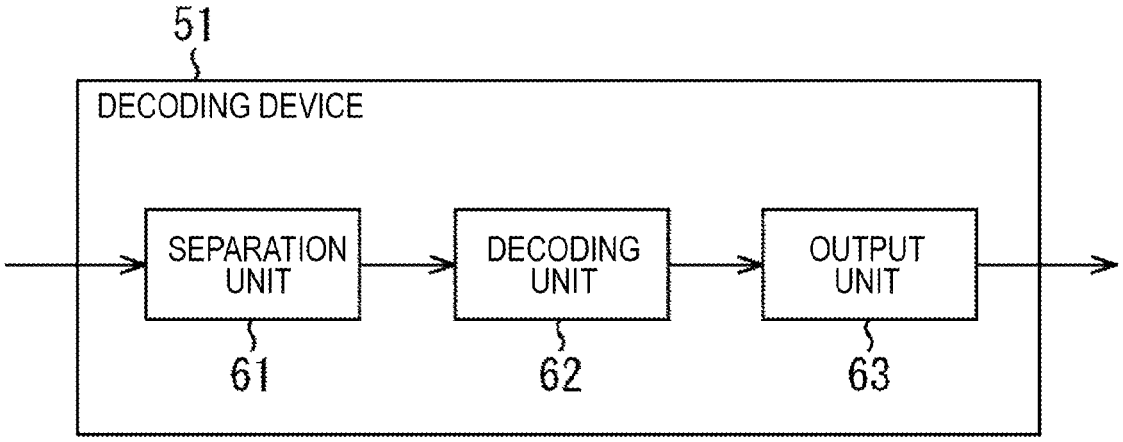
FIG. 24 is a diagram illustrating an example of the structure of a decoding device.
Figure 25:
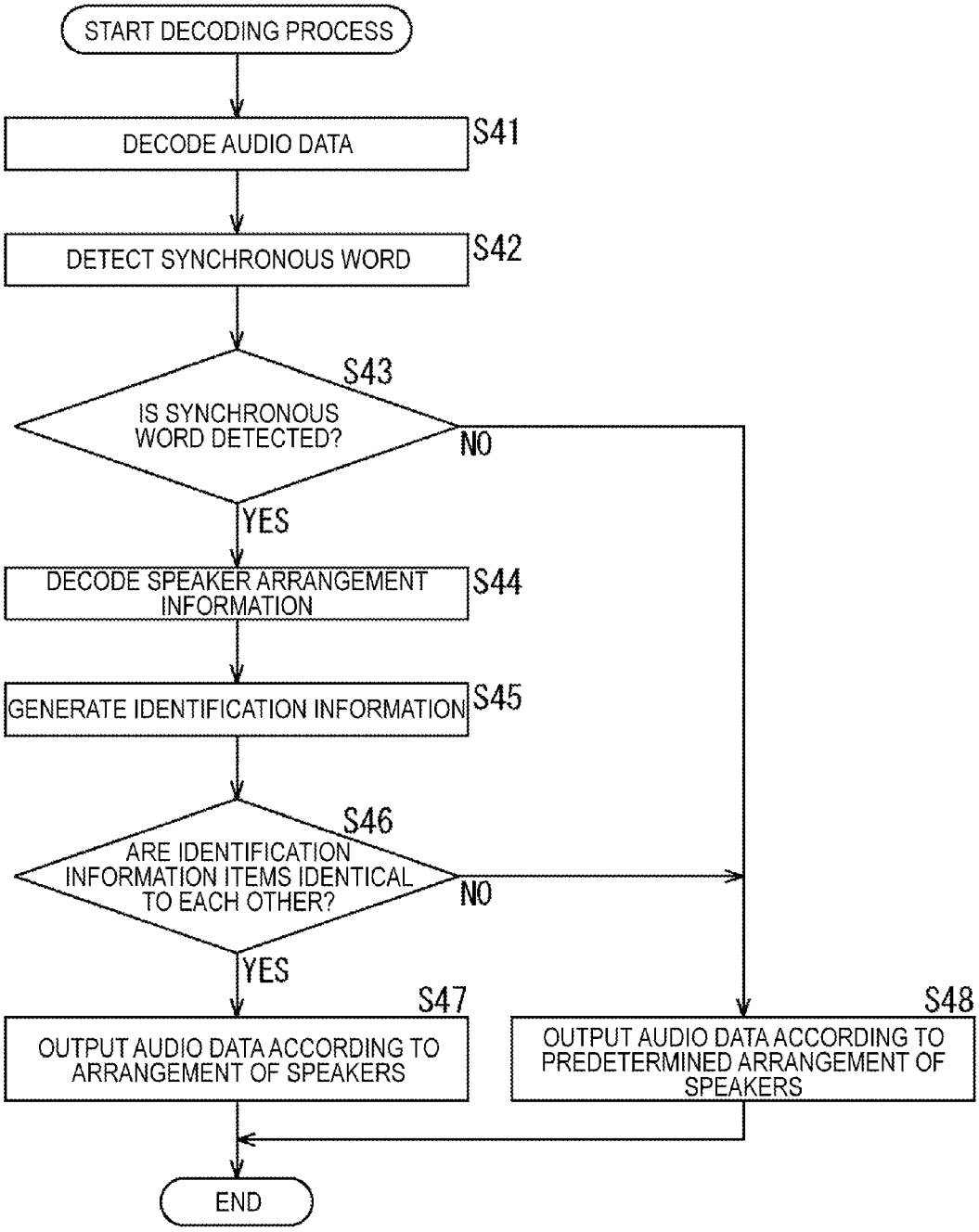
FIG. 25 is a flowchart illustrating a decoding process.

FIG. 24 is a diagram illustrating an example of the structure of the decoding device. A decoding device 51 includes a separation unit 61, a decoding unit 62, and an output unit 63.

The separation unit 61 receives the encoded bit stream transmitted from the encoding device 11, performs bit unpacking for the encoded bit stream, and supplies the unpacked encoded bit stream to the decoding unit 62.

The decoding unit 62 decodes, for example, the encoded bit stream supplied from the separation unit 61, that is, the audio data of each channel or the speaker arrangement information and supplies the decoded audio data to the output unit 63. For example, the decoding unit 62 downmixes the audio data, if necessary.

The output unit 63 outputs the audio data supplied from the decoding unit 62 on the basis of the arrangement of the speakers (speaker mapping) designated by the decoding unit 62. The audio data of each channel output from the output unit 63 is supplied to the speakers of each channel and is then reproduced.

[Description of a Decoding Operation]

Next, a decoding process of the decoding device 51 will be described with reference to the flowchart illustrated in FIG.

In Step S41, the decoding unit 62 decodes audio data.

That is, the separation unit 61 receives the encoded bit stream transmitted from the encoding device 11 and performs bit unpacking for the encoded bit stream. Then, the separation unit 61 supplies audio data obtained by the bit unpacking and various kinds of information, such as the speaker arrangement information, to the decoding unit 62. The decoding unit 62 decodes the audio data supplied from the separation unit 61 and supplies the decoded audio data to the output unit 63.

In Step S42, the decoding unit 62 detects the synchronous word from the information supplied from the separation unit 61. Specifically, the synchronous word is detected from "height_extension_element" illustrated in FIG. 4.

In Step S43, the decoding unit 62 determines whether the synchronous word is detected. When it is determined in Step S43 that the synchronous word is detected, the decoding unit 62 decodes the speaker arrangement information in Step S44.

That is, the decoding unit 62 reads information, such as "front_element_height_info[i]", "side_element_height_info [i]", and "back_element_height_info [i]" from "height_extension_element" illustrated in FIG. 4. In this way, it is possible to find the positions (channels) of the speakers where each audio data item can be reproduced with high quality.

In Step S45, the decoding unit 62 generates identification information. That is, the decoding unit 62 calculates the CRC check code on the basis of information which is read between "PCE_HEIGHT_EXTENSION_SYNC" and "byte_alignment( )" in "height_extension_element", that is, the synchronous word, the speaker arrangement information, and byte alignment and obtains the identification information.

In Step S46, the decoding unit 62 compares the identification information generated in Step S45 with the identification information included in "height_info_crc_check" of "height_extension_element" illustrated in FIG. 4 and determines whether the identification information items are identical to each other.

When it is determined in Step S46 that the identification information items are identical to each other, the decoding unit 62 supplies the decoded audio data to the output unit 63 and instructs the output of the audio data on the basis of the obtained speaker arrangement information. Then, the process proceeds to Step S47.

In Step S47, the output unit 63 outputs the audio data supplied from the decoding unit 62 on the basis of the speaker arrangement (speaker mapping) indicated by the decoding unit 62. Then, the decoding process ends.

On the other hand, when it is determined in Step S43 that the synchronous word is not detected or when it is determined in Step S46 that the identification information items are not identical to each other, the output unit 63 outputs the audio data on the basis of predetermined speaker arrangement in Step S48.

That is, when the speaker arrangement information is correctly read from "height_extension_element", the process in Step S48 is performed. In this case, the decoding unit 62 supplies the audio data to the output unit 63 and instructs the output of the audio data such that the audio data of each channel is reproduced by the speakers of each predetermined channel. Then, the output unit 63 outputs the audio data in response to the instructions from the decoding unit 62 and the decoding process ends.

In this way, the decoding device 51 decodes the speaker arrangement information or the audio data included in the encoded bit stream and outputs the audio data on the basis of the speaker arrangement information. Since the speaker arrangement information includes the information about the arrangement of the speakers in the vertical direction, it is possible to reproduce a sound image in the vertical direction, in addition to in the plane. Therefore, it is possible to reproduce a more realistic sound.

Specifically, when the audio data is decoded, for example, a process of downmixing the audio data is also performed, if necessary.

In this case, for example, the decoding unit 62 reads "MPEG4_ext_ancillary_data( )" when "ancillary_data_extension_status" in "ancillary_data_status( )" of "MPEG4 ancillary data" illustrated in FIG. 6 is "1". Then, the decoding unit 62 reads each information item included in "MPEG4_ext_ancillary_data( )" illustrated in FIG. 11 and performs an audio data downmixing process or a gain correction process.

For example, the decoding unit 62 downmixes audio data of 7.1 channels or 6.1 channels to audio data of 5.1 channels or further downmixes audio data of 5.1 channels to audio data of 2 channels.

In this case, the decoding unit 62 uses the audio data of the LFE channel for downmixing, if necessary. The coefficients multiplied by each channel are determined with reference to "ext_downmixing_levels( )" illustrated in FIG. 13 or "ext_downmixing_lfe_level( )" illustrated in FIG. 16. In addition, gain correction during downmixing is performed with reference to "ext_downmixing_global_gains( )" illustrated in FIG.

[Example Structure of an Encoding Device]

Next, an example of the detailed structure of the above-mentioned encoding device and decoding device and the detailed operation of these devices will be described.

Figure 26:
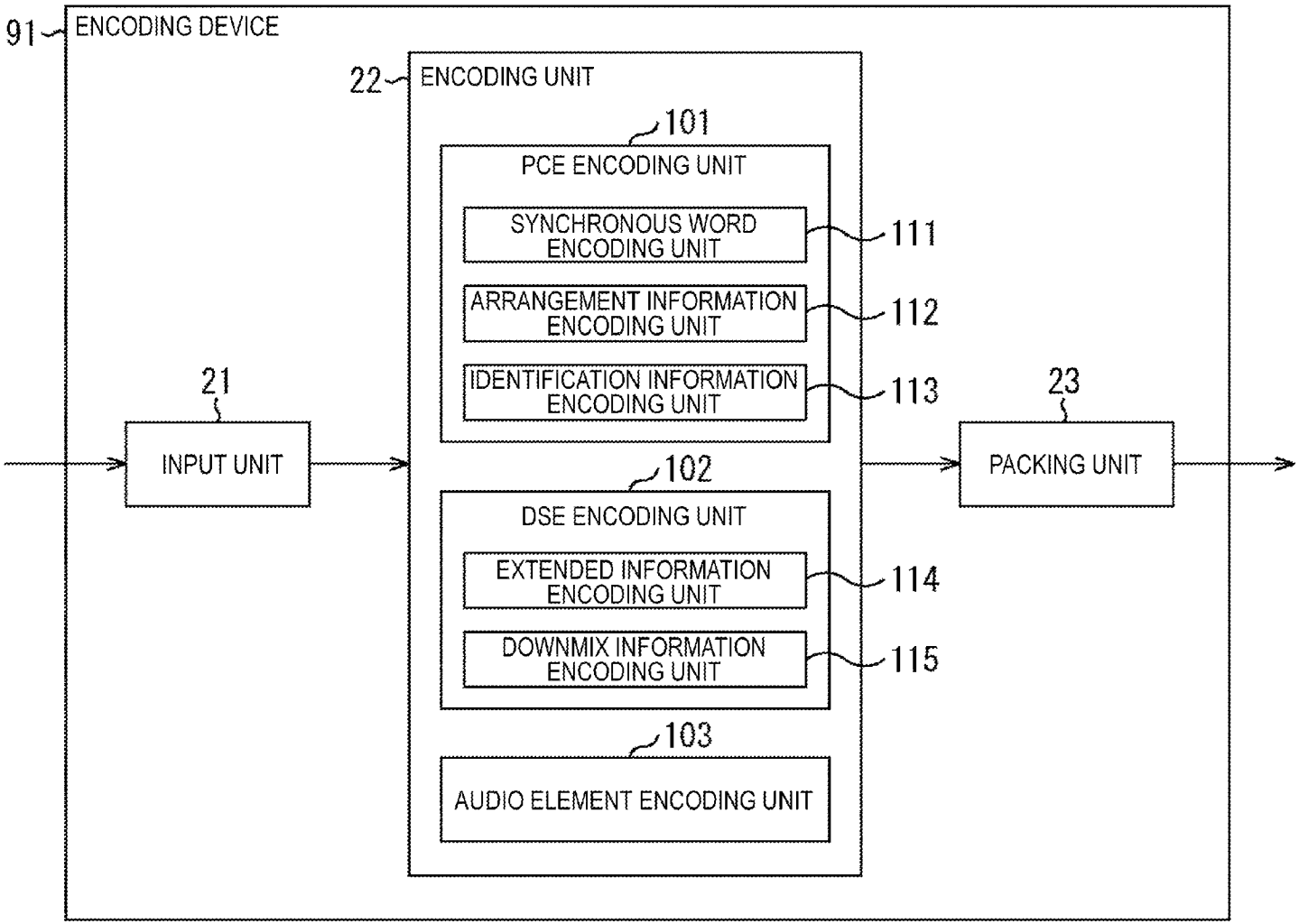
FIG. 26 is a diagram illustrating an example of the structure of an encoding device.

FIG. 26 is a diagram illustrating an example of the detailed structure of the encoding device.

The encoding device 91 includes an input unit 21, an encoding unit 22, and a packing unit 23. In FIG. 26, components corresponding to those illustrated in FIG. 22 are denoted by the same reference numerals and the description thereof will not be repeated.

The encoding unit 22 includes a PCE encoding unit 101, a DSE encoding unit 102, and an audio element encoding unit 103.

The PCE encoding unit 101 encodes a PCE on the basis of information supplied from the input unit 21. That is, the PCE encoding unit 101 generates each information item which is to be stored in the PCE while encoding each information item, if necessary. The PCE encoding unit 101 includes a synchronous word encoding unit 111, an arrangement information encoding unit 112, and an identification information encoding unit 113.

The synchronous word encoding unit 111 encodes the synchronous word and uses the encoded synchronous word as information which is to be stored in the extended region included in the comment region of the PCE. The arrangement information encoding unit 112 encodes the speaker arrangement information which indicates the heights (layers) of the speakers for each audio data item and is supplied from the input unit 21, and uses the encoded speaker arrangement information as the information which is to be stored in the extended region of the comment region.

The identification information encoding unit 113 encodes identification information. For example, the identification information encoding unit 113 generates the CRC check code as the identification information on the basis of the synchronous word and the speaker arrangement information, if necessary, and uses the CRC check code as the information which is to be stored in the extended region of the comment region.

The DSE encoding unit 102 encodes a DSE on the basis of the information supplied from the input unit 21. That is, the DSE encoding unit 102 generates each information item which is to be stored in the DSE while encoding each information item, if necessary. The DSE encoding unit 102 includes an extended information encoding unit 114 and a downmix information encoding unit 115.

The extended information encoding unit 114 encodes information (flag) indicating whether extended information is included in "MPEG4_ext_ancillary_data( )" which is an extended region of the DSE. The downmix information encoding unit 115 encodes information about the downmixing of audio data. The audio element encoding unit 103 encodes the audio data supplied from the input unit 21.

The encoding unit 22 supplies information obtained by encoding each type of data, which is to be stored in each element to the packing unit 23.

[Description of Encoding Process]

Figure 27:
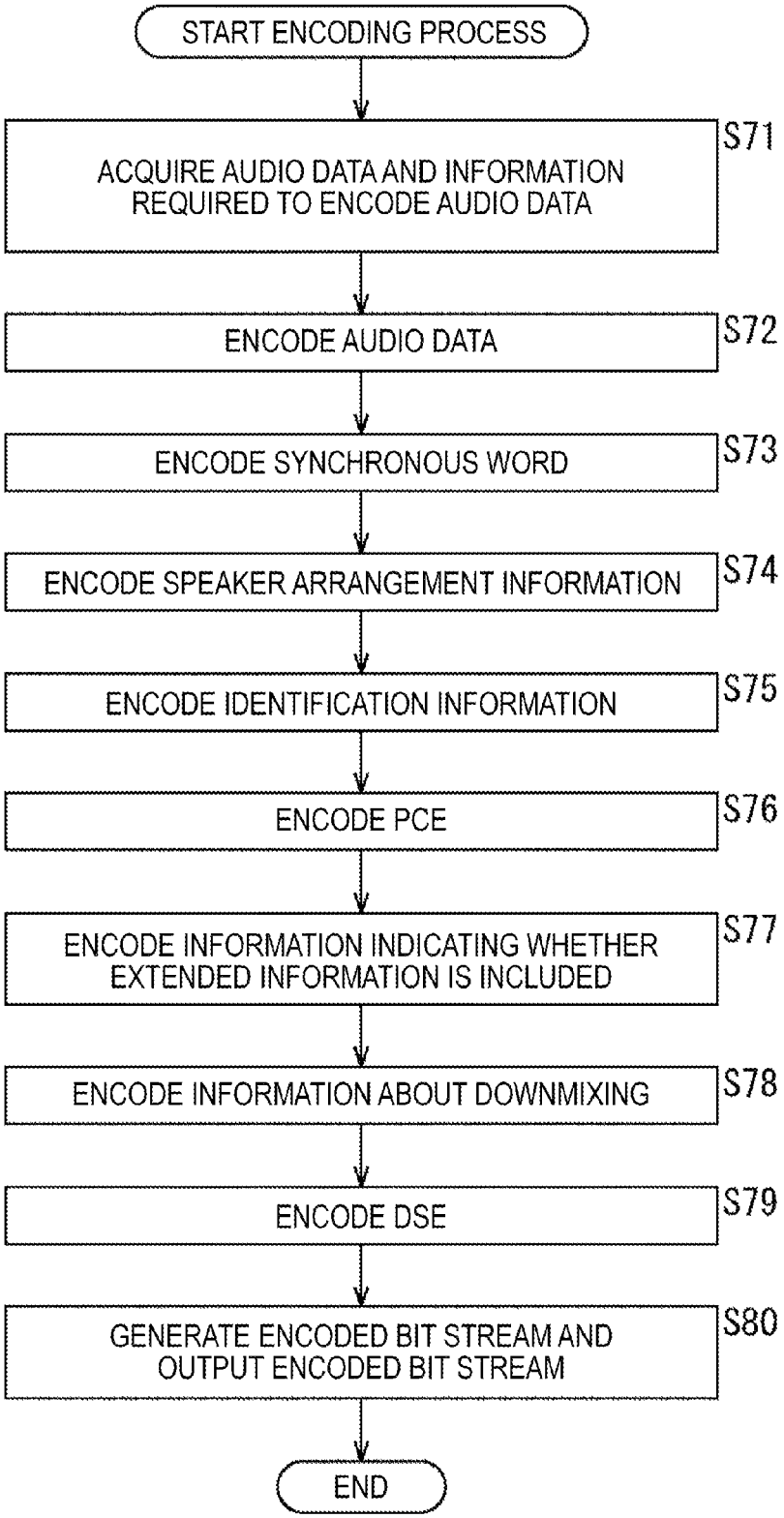
FIG. 27 is a flowchart illustrating an encoding process.

Next, an encoding process of the encoding device 91 will be described with reference to the flowchart illustrated in FIG. 27. The encoding process is more detailed than the process which has been described with reference to the flowchart illustrated in FIG. 23.

In Step S71, the input unit 21 acquires audio data and information required to encode the audio data and supplies the audio data and the information to the encoding unit 22.

For example, the input unit 21 acquires, as the audio data, the pulse code modulation (PCM) data of each channel, information indicating the arrangement of each channel speaker, information for specifying a downmix coefficient, and information indicating the bit rate of the encoded bit stream. Here, the information for specifying the downmix coefficient is information indicating a coefficient which is multiplied by the audio data of each channel during downmixing from 7.1 channels or 6.1 channels to 5.1 channels and downmixing from 5.1 channels to 2 channels.

In addition, the input unit 21 acquires the file name of the encoded bit stream to be obtained. The file name is appropriately used by the encoding device.

In Step S72, the audio element encoding unit 103 encodes the audio data supplied from the input unit 21 and the encoded audio data is to be stored in each element, such as SCE, CPE, and LFE. In this case, the audio data is encoded at a bit rate which is determined by the bit rate supplied from the input unit 21 to the encoding unit 22 and the number of codes in information other than the audio data.

For example, the audio data of the C channel or the Cs channel is to be encoded and stored in the SCE. The audio data of the L channel or the R channel is to be encoded and stored in the CPE. In addition, the audio data of the LFE channel is to be encoded and stored in the LFE.

In Step S73, the synchronous word encoding unit 111 encodes the synchronous word on the basis of the information supplied from the input unit 21 and the encoded synchronous word is information to be stored in "PCE_HEIGHT_EXTENSION_SYNC" of "height_extension_element" illustrated in FIG. 4.

In Step S74, the arrangement information encoding unit 112 encodes the speaker arrangement information of each audio data which is supplied from the input unit 21.

The encoded speaker arrangement information is stored in "height_extension_element" at a sound source position in the packing unit 23, that is, in an order corresponding to the arrangement of the speakers. That is, speaker arrangement information indicating the speaker height (the height of the sound source) of each channel reproduced by the speaker which is arranged in front of the user is stored as "front_element_height_info[i]" in "height_extension_element".

In addition, speaker arrangement information indicating the speaker height of each channel reproduced by the speaker which is arranged on the side of the user is stored as "side_element_height_info[i]" in "height_extension_element", subsequently to "front_element_height_info[i]". Then, speaker arrangement information indicating the speaker height of each channel reproduced by the speaker which is arranged on the rear side of the user is stored as "back_element_height_info[i]" in "height_extension_element", subsequently to "side_element_height_info[i]".

In Step S75, the identification information encoding unit 113 encodes identification information. For example, the identification information encoding unit 113 generates a CRC check code as the identification information on the basis of the synchronous word and the speaker arrangement information, if necessary. The CRC check code is information which is to be stored in "height_info_crc_check" of "height_extension_element". The synchronous word and the CRC check code are information for identifying whether the speaker arrangement information is present in the encoded bit stream.

In addition, the identification information encoding unit 113 generates information instructing the execution of byte alignment as information which is to be stored in "byte_alignment( )" of "height_extension_element". The identification information encoding unit 113 generates information instructing the comparison of the identification information as information which is to be stored in "if(crc_cal( )!=height_info_crc_check)" of "height_extension_element".

Information to be stored in the extended region included in the comment region of the PCE, that is, "height_extension_element" is generated by the process from Step S73 to Step S75.

In Step S76, the PCE encoding unit 101 encodes the PCE on the basis of, for example, the information supplied from the input unit 21 or the generated information which is stored in the extended region.

For example, the PCE encoding unit 101 generates, as information to be stored in the PCE, information indicating the number of channels reproduced by the front, side, and rear speakers or information indicating to which of the C, L, and R channels each audio data item belongs.

In Step S77, the extended information encoding unit 114 encodes information indicating whether the extended information is included in the extended region of the DSE, on the basis of the information supplied from the input unit 21 and the encoded information is to be stored in "ancillary_data_extension_status" of "ancillary_data_status( )" illustrated in FIG. 8. For example, as information indicating whether the extended information is included, that is, information indicating whether there is the extended information is stored, "0" or "1" is to be stored in "ancillary_data_extension_status".

In Step S78, the downmix information encoding unit 115 encodes information about the downmixing of audio data on the basis of the information supplied from the input unit 21.

For example, the downmix information encoding unit 115 encodes information for specifying the downmix coefficient supplied from the input unit 21. Specifically, the downmix information encoding unit 115 encodes information indicating a coefficient which is multiplied by the audio data of each channel during downmixing from 5.1 channels to 2 channels and is to be "center_mix_level_value" and "surround_mix_level_value" stored in "downmixing_levels_MPEG4( )" illustrated in FIG. 9.

In addition, the downmix information encoding unit 115 encodes information indicating a coefficient which is multiplied by the audio data of the LFE channel during downmixing from 5.1 channels to 2 channels and is to be "dmix_lfe_idx" stored in "ext_downmixing_lfe_level( )" illustrated in FIG. 16. Similarly, the downmix information encoding unit 115 encodes information indicating the procedure of downmix to 2 channels which is supplied from the input unit 21 and is to be "pseudo_surround_enable" stored in "bs_info( )" illustrated in FIG. 7.

The downmix information encoding unit 115 encodes information indicating a coefficient which is multiplied by the audio data of each channel during downmixing from 7.1 channels or 6.1 channels to 5.1 channels and is to be "dmix_a_idx" and "dmix_b_idx" stored in "ext_downmixing_levels" illustrated in FIG. 13.

The downmix information encoding unit 115 encodes information indicating whether to use the LFE channel during downmixing from 5.1 channels to 2 channels. The encoded information is to be stored in"ext_downmixing_lfe_level_status" illustrated in FIG. 12 included in "ext_ancillary_data_status( )" illustrated in FIG. 11 which is the extended region.

The downmix information encoding unit 115 encodes information required for gain adjustment during downmix. The encoded information is to be stored in "ext_downmixing_global_gains" in "MPEG4_ext_ancillary_data( )" illustrated in FIG. 11.

In Step S79, the DSE encoding unit 102 encodes the DSE on the basis of the information supplied from the input unit 21 or the generated information about downmixing.

Information to be stored in each element, such as PCE, SCE, CPE, LFE, and DSE, is obtained by the above-mentioned process. The encoding unit 22 supplies the information to be stored in each element to the packing unit 23. In addition, the encoding unit 22 generates elements, such as "Header/Sideinfo", "FIL(DRC)", and "FIL(END)", and supplies the generated elements to the packing unit 23, if necessary.

In Step S80, the packing unit 23 performs bit packing for the audio data or the speaker arrangement information supplied from the encoding unit 22 to generate the encoded bit stream illustrated in FIG. 3 and outputs the encoded bit stream. For example, the packing unit 23 stores the information supplied from the encoding unit 22 in the PCE or the DSE to generate the encoded bit stream. When the encoded bit stream is output, the encoding process ends.

In this way, the encoding device 91 inserts, for example, the speaker arrangement information, the information about downmixing, and the information indicating whether the extended information is included in the extended region into the encoded bit stream and outputs the encoded audio data. As such, when the speaker arrangement information and the information about downmixing are stored in the encoded bit stream, on the decoding side of the encoded bit stream, a high-quality realistic sound can be obtained.

For example, when the information about the arrangement of the speakers in the vertical direction is stored in the encoded bit stream, on the decoding side, a sound image in the vertical direction as well as in the plane can be reproduced. Therefore, it is possible to reproduce a realistic sound.

In addition, the encoded bit stream includes a plurality of identification information items (identification codes) for identifying the speaker arrangement information, in order to identify whether the information stored in the extended region of the comment region is the speaker arrangement information or text information, such as other comments. In this embodiment, the encoded bit stream includes, as the identification information, the synchronous word which is arranged immediately before the speaker arrangement information and the CRC check code which is determined by the content of the stored information, such as the speaker arrangement information.

When the two identification information items are included in the encoded bit stream, it is possible to reliably specify whether the information included in the encoded bit stream is the speaker arrangement information. As a result, it is possible to obtain a high-quality realistic sound using the obtained speaker arrangement information.

In addition, in the encoded bit stream, as information for downmixing audio data, "pseudo_surround_enable" is included in the DSE. This information makes it possible to designate any one of a plurality of methods as a method of downmixing channels from 5.1 channels to 2 channels. Therefore, it is possible to improve flexibility in an audio data on the decoding side.

Specifically, in this embodiment, as the method of downmixing channels from 5.1 channels to 2 channels, there are a method using Expression (1) and a method using Expression (2). For example, on the decoding side, the audio data of 2 channels obtained by downmixing is transmitted to a reproduction device and the reproduction device converts the audio data of 2 channels into audio data of 5.1 channels and reproduces the converted audio data.

In this case, in the method using Expression (1) and the method using Expression (2), an appropriate acoustic effect which is assumed in advance when the final audio data of 5.1 channels is reproduced is not likely to be obtained from the audio data obtained by any one of the two methods.

However, in the encoded bit stream obtained by the encoding device 91, a downmixing method capable of obtaining the acoustic effect assumed on the decoding side can be designated by "pseudo_surround_enable". Therefore, a high-quality realistic sound can be obtained on the decoding side.

In addition, in the encoded bit stream, the information (flag) indicating whether the extended information is included is stored in "ancillary_data_extension_status". Therefore, it is possible to specify whether the extended information is included in "MPEG4_ext_ancillary_data( )", which is the extended region, with reference to this information.

For example, in this example, as the extended information, "ext_ancillary_data_status( )", "ext_downmixing_levels( )", "ext_downmixing_global_gains", and "ext_downmixing_lfe_level( )" are stored in the extended region, if necessary.

When the extended information can be obtained, it is possible to improve flexibility in the downmixing of audio data and various kinds of the audio data can be obtained on the decoding side. As a result, it is possible to obtain a high-quality realistic sound.

[Example Structure of a Decoding Device]

Next, the detailed structure of the decoding device will be described.

Figure 28:
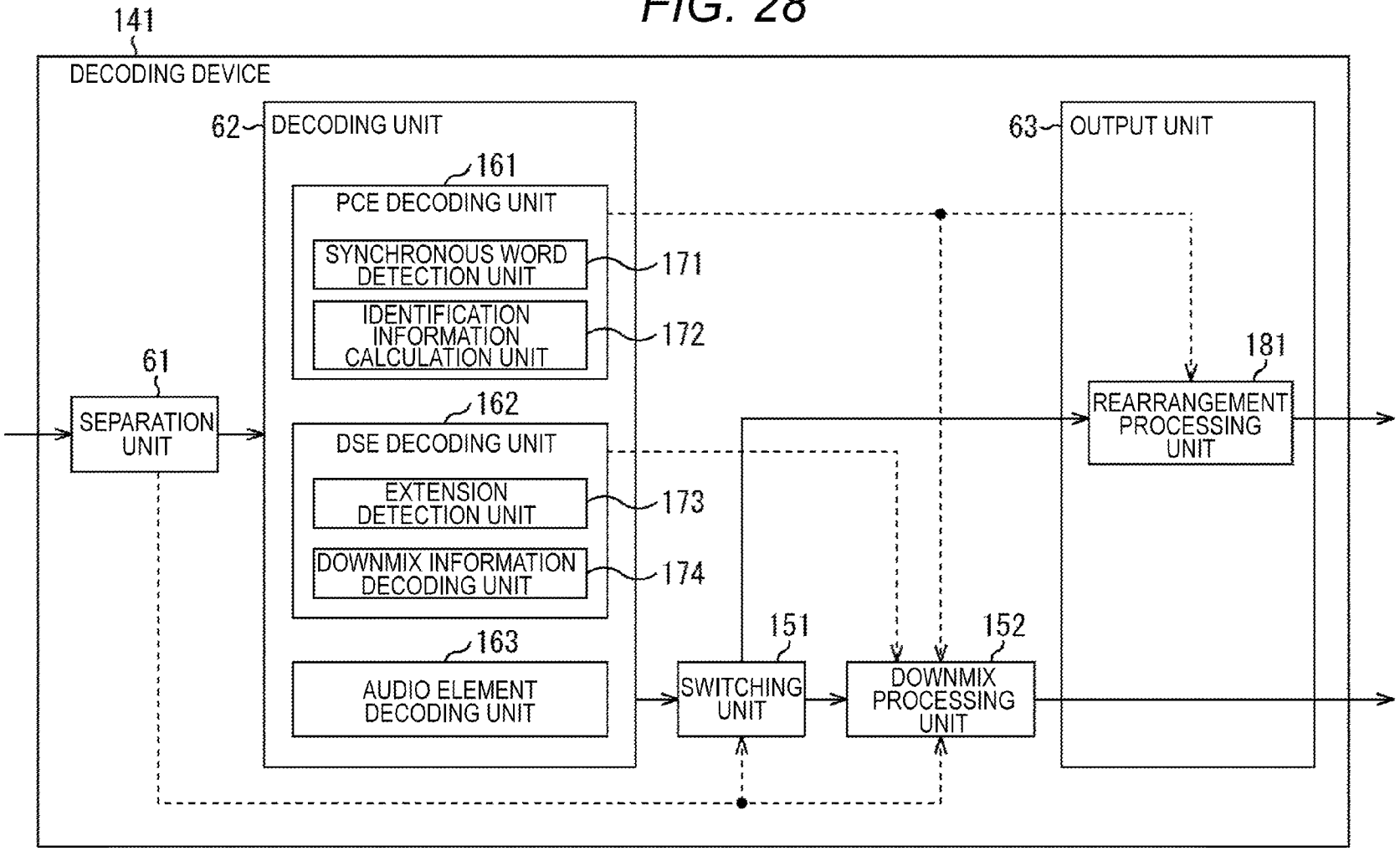
FIG. 28 is a diagram illustrating an example of a decoding device.

FIG. 28 is a diagram illustrating an example of the detailed structure of the decoding device. In FIG. 28, components corresponding to those illustrated in FIG. 24 are denoted by the same reference numerals and the description thereof will not be repeated.

A decoding device 141 includes a separation unit 61, a decoding unit 62, a switching unit 151, a downmix processing unit 152, and an output unit 63.

The separation unit 61 receives the encoded bit stream output from the encoding device 91, unpacks the encoded bit stream, and supplies the encoded bit stream to the decoding unit 62. In addition, the separation unit 61 acquires a downmix formal parameter and the file name of audio data.

The downmix formal parameter is information indicating the downmix form of audio data included in the encoded bit stream in the decoding device 141. For example, information indicating downmixing from 7.1 channels or 6.1 channels to 5.1 channels, information indicating downmixing from 7.1 channels or 6.1 channels to 2 channels, information indicating downmixing from 5.1 channels to 2 channels, or information indicating that downmixing is not performed is included as the downmix formal parameter.

The downmix formal parameter acquired by the separation unit 61 is supplied to the switching unit 151 and the downmix processing unit 152. In addition, the file name acquired by the separation unit 61 is appropriately used in the decoding device 141.

The decoding unit 62 decodes the encoded bit stream supplied from the separation unit 61. The decoding unit 62 includes a PCE decoding unit 161, a DSE decoding unit 162, and an audio element decoding unit 163.

The PCE decoding unit 161 decodes the PCE included in the encoded bit stream and supplies information obtained by the decoding to the downmix processing unit 152 and the output unit 63. The PCE decoding unit 161 includes a synchronous word detection unit 171 and an identification information calculation unit 172.

The synchronous word detection unit 171 detects the synchronous word from the extended region in the comment region of the PCE and reads the synchronous word. The identification information calculation unit 172 calculates identification information on the basis of the information which is read from the extended region in the comment region of the PCE.

The DSE decoding unit 162 decodes the DSE included in the encoded bit stream and supplies information obtained by the decoding to the downmix processing unit 152. The DSE decoding unit 162 includes an extension detection unit 173 and a downmix information decoding unit 174.

The extension detection unit 173 detects whether the extended information is included in "MPEG4_ancillary_data( )" of the DSE. The downmix information decoding unit 174 decodes information about downmixing which is included in the DSE.

The audio element decoding unit 163 decodes the audio data included in the encoded bit stream and supplies the audio data to the switching unit 151.

The switching unit 151 changes the output destination of the audio data supplied from the decoding unit 62 to the downmix processing unit 152 or the output unit 63 on the basis of the downmix formal parameter supplied from the separation unit 61.

The downmix processing unit 152 downmixes the audio data supplied from the switching unit 151 on the basis of the downmix formal parameter from the separation unit 61 and the information from the decoding unit 62 and supplies the downmixed audio data to the output unit 63.

The output unit 63 outputs the audio data supplied from the switching unit 151 or the downmix processing unit 152 on the basis of the information supplied from the decoding unit 62. The output unit 63 includes a rearrangement processing unit 181. The rearrangement processing unit 181 rearranges the audio data supplied from the switching unit 151 on the basis of the information supplied from the PCE decoding unit 161 and outputs the audio data.

[Example of Structure of Downmix Processing Unit]

Figure 29:
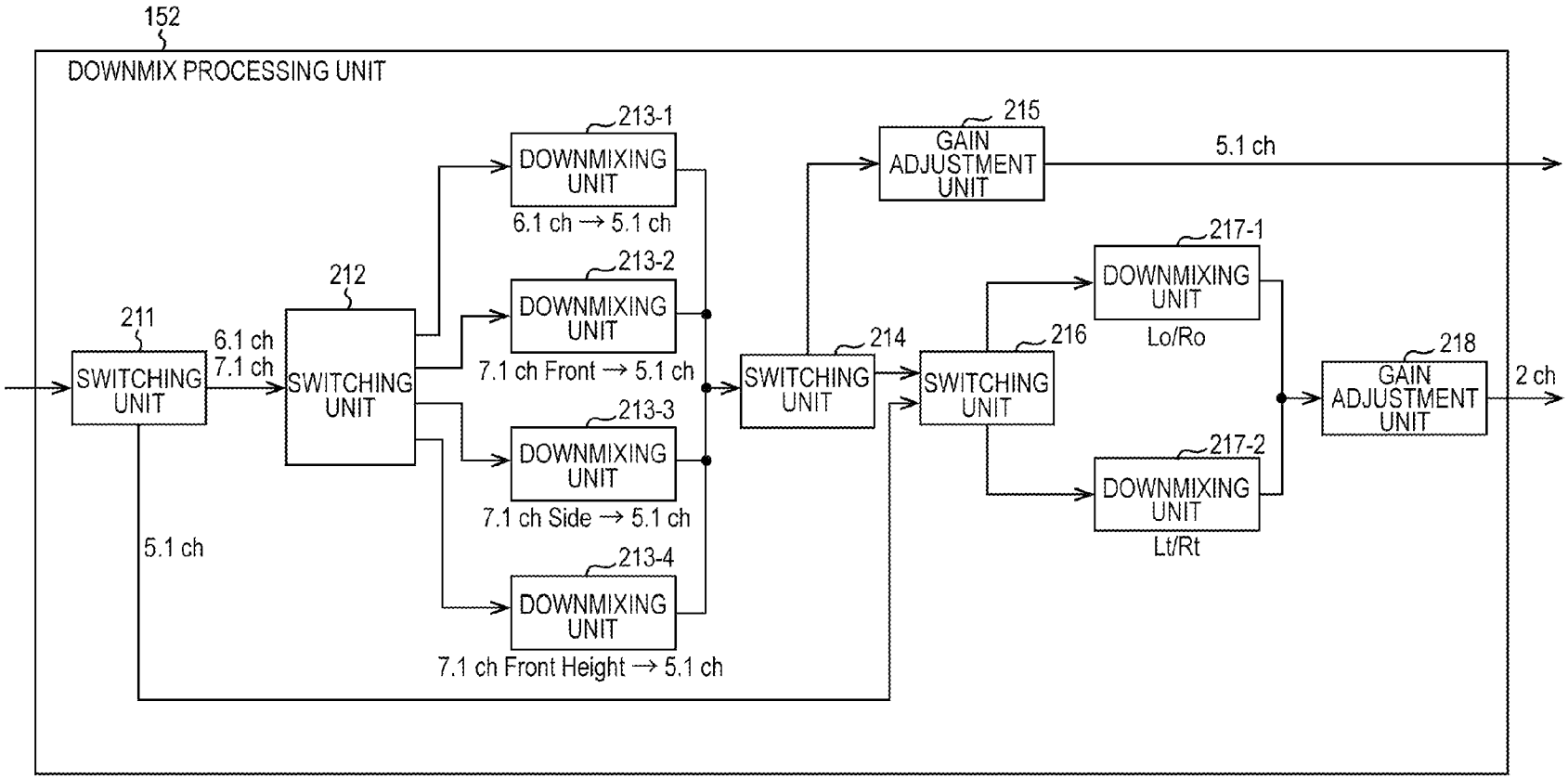
FIG. 29 is a diagram illustrating an example of the structure of a downmix processing unit.

FIG. 29 illustrates the detailed structure of the downmix processing unit 152 illustrated in FIG. 28. That is, the downmix processing unit 152 includes a switching unit 211, a switching unit 212, downmixing units 213-1 to 213-4, a switching unit 214, a gain adjustment unit 215, a switching unit 216, a downmixing unit 217-1, a downmixing unit 217-2, and a gain adjustment unit 218.

The switching unit 211 supplies the audio data supplied from the switching unit 151 to the switching unit 212 or the switching unit 216. For example, the output destination of the audio data is the switching unit 212 when the audio data is data of 7.1 channels or 6.1 channels and is the switching unit 216 when the audio data is data of 5.1 channels.

The switching unit 212 supplies the audio data supplied from the switching unit 211 to any one of the downmixing units 213-1 to 213-4. For example, the switching unit 212 outputs the audio data to the downmixing unit 213-1 when the audio data is data of 6.1 channels.

When the audio data is data of the channels L, Lc, C, Rc, R, Ls, Rs, and LFE, the switching unit 212 supplies the audio data from the switching unit 211 to the downmixing unit 213-2. When the audio data is data of the channels L, R, C, Ls, Rs, Lrs, Rrs, and LFE, the switching unit 212 supplies the audio data from the switching unit 211 to the downmixing unit 213-3.

When the audio data is data of the channels L, R, C, Ls, Rs, Lvh, Rvh, and LFE, the switching unit 212 supplies the audio data from the switching unit 211 to the downmixing unit 213-4.

The downmixing units 213-1 to 213-4 downmix the audio data supplied from the switching unit 212 to audio data of 5.1 channels and supplies the audio data to the switching unit 214. Hereinafter, when the downmixing units 213-1 to 213-4 do not need to be particularly distinguished from each other, they are simply referred to as downmixing units 213.

The switching unit 214 supplies the audio data supplied from the downmixing unit 213 to the gain adjustment unit 215 or the switching unit 216. For example, when the audio data included in the encoded bit stream is downmixed to audio data of 5.1 channels, the switching unit 214 supplies the audio data to the gain adjustment unit 215. On the other hand, when the audio data included in the encoded bit stream is downmixed to audio data of 2 channels, the switching unit 214 supplies the audio data to the switching unit 216.

The gain adjustment unit 215 adjusts the gain of the audio data supplied from the switching unit 214 and supplies the audio data to the output unit 63.

The switching unit 216 supplies the audio data supplied from the switching unit 211 or the switching unit 214 to the downmixing unit 217-1 or the downmixing unit 217-2. For example, the switching unit 216 changes the output destination of the audio data depending on the value of "pseudo_surround_enable" included in the DSE of the encoded bit stream.

The downmixing unit 217-1 and the downmixing unit 217-2 downmix the audio data supplied from the switching unit 216 to data of 2 channels and supply the data to the gain adjustment unit 218. Hereinafter, when the downmixing unit 217-1 and the downmixing unit 217-2 do not need to be particularly distinguished from each other, they are simply referred to as downmixing units 217.

The gain adjustment unit 218 adjusts the gain of the audio data supplied from the downmixing unit 217 and supplies the audio data to the output unit 63.

[Example of Structure of Downmixing Unit]

Next, an example of the detailed structure of the downmixing unit 213 and the downmixing unit 217 illustrated in FIG. 29 will be described.

Figure 30:
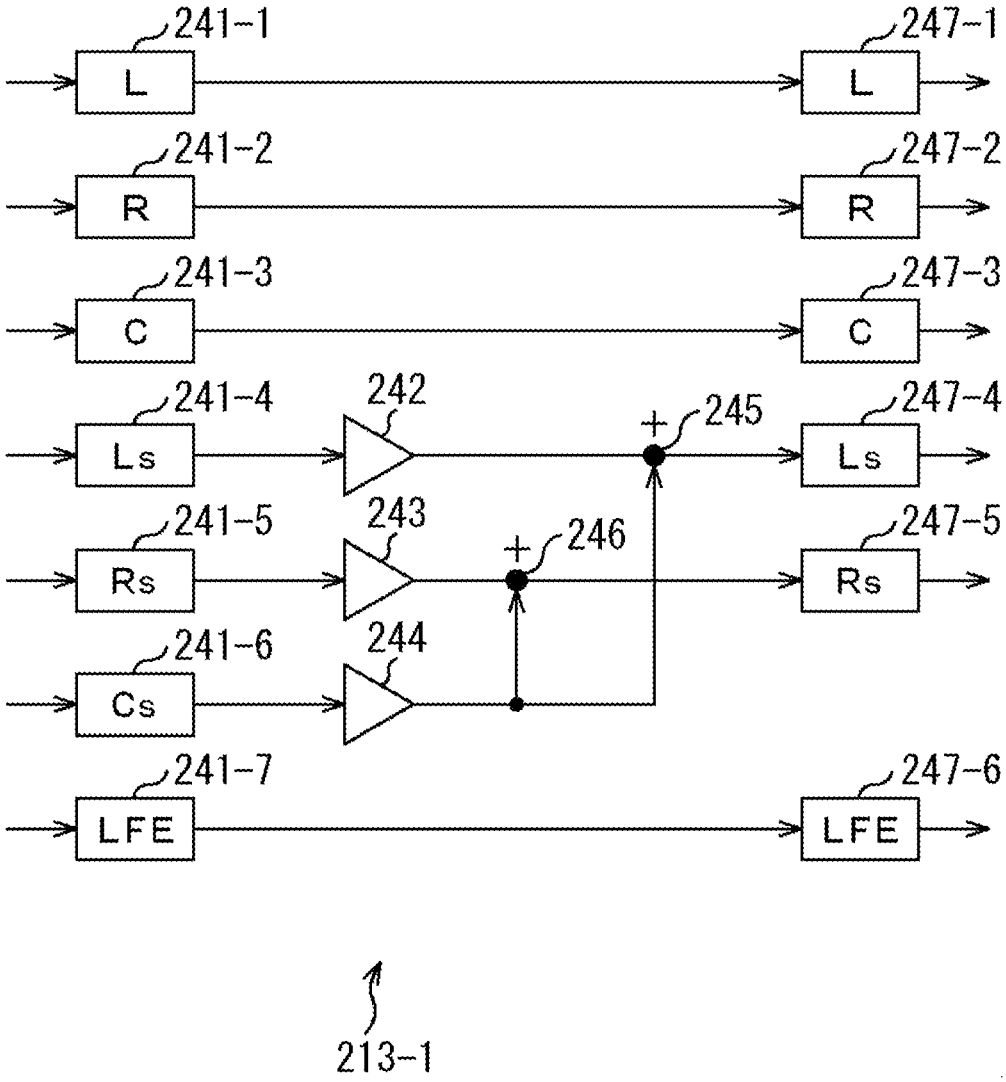
FIG. 30 is a diagram illustrating an example of the structure of a downmixing unit.

FIG. 30 is a diagram illustrating an example of the structure of the downmixing unit 213-1 illustrated in FIG. 29.

The downmixing unit 213-1 includes input terminals 241-1 to 241-7, multiplication units 242 to 244, an addition unit 245, an addition unit 246, and output terminals 247-1 to 247-6.

The audio data of the channels L, R, C, Ls, Rs, Cs, and LFE is supplied from the switching unit 212 to the input terminals 241-1 to 241-7.

The input terminals 241-1 to 241-3 supply the audio data supplied from the switching unit 212 to the switching unit 214 through the output terminals 247-1 to 247-3, without any change in the audio data. That is, the audio data of the channels L, R, and C which is supplied to the downmixing unit 213-1 is downmixed and output as the audio data of the channels L, R, and C after downmixing to the next stage.

The input terminals 241-4 to 241-6 supply the audio data supplied from the switching unit 212 to the multiplication units 242 to 244. The multiplication unit 242 multiplies the audio data supplied from the input terminal 241-4 by a downmix coefficient and supplies the audio data to the addition unit 245.

The multiplication unit 243 multiplies the audio data supplied from the input terminal 241-5 by a downmix coefficient and supplies the audio data to the addition unit 246. The multiplication unit 244 multiplies the audio data supplied from the input terminal 241-6 by a downmix coefficient and supplies the audio data to the addition unit 245 and the addition unit 246.

The addition unit 245 adds the audio data supplied from the multiplication unit 242 and the audio data supplied from the multiplication unit 244 and supplies the added audio data to the output terminal 247-4. The output terminal 247-4 supplies the audio data supplied from the addition unit 245 as the audio data of the Ls channel after downmixing to the switching unit 214.

The addition unit 246 adds the audio data supplied from the multiplication unit 243 and the audio data supplied from the multiplication unit 244 and supplies the added audio data to the output terminal 247-5. The output terminal 247-5 supplies the audio data supplied from the addition unit 246 as the audio data of the Rs channel after downmixing to the switching unit 214.

The input terminal 241-7 supplies the audio data supplied from the switching unit 212 to the switching unit 214 through the output terminal 247-6, without any change in the audio data. That is, the audio data of the LFE channel supplied to the downmixing unit 213-1 is output as the audio data of the LFE channel after downmixing to the next stage, without any change.

Hereinafter, when the input terminals 241-1 to 241-7 do not need to be particularly distinguished from each other, they are simply referred to as input terminals 241. When the output terminals 247-1 to 247-6 do not need to be particularly distinguished from each other, they are simply referred to as output terminals 247.

As such, in the downmixing unit 213-1, a process corresponding to calculation using the above-mentioned Expression (6) is performed.

Figure 31:
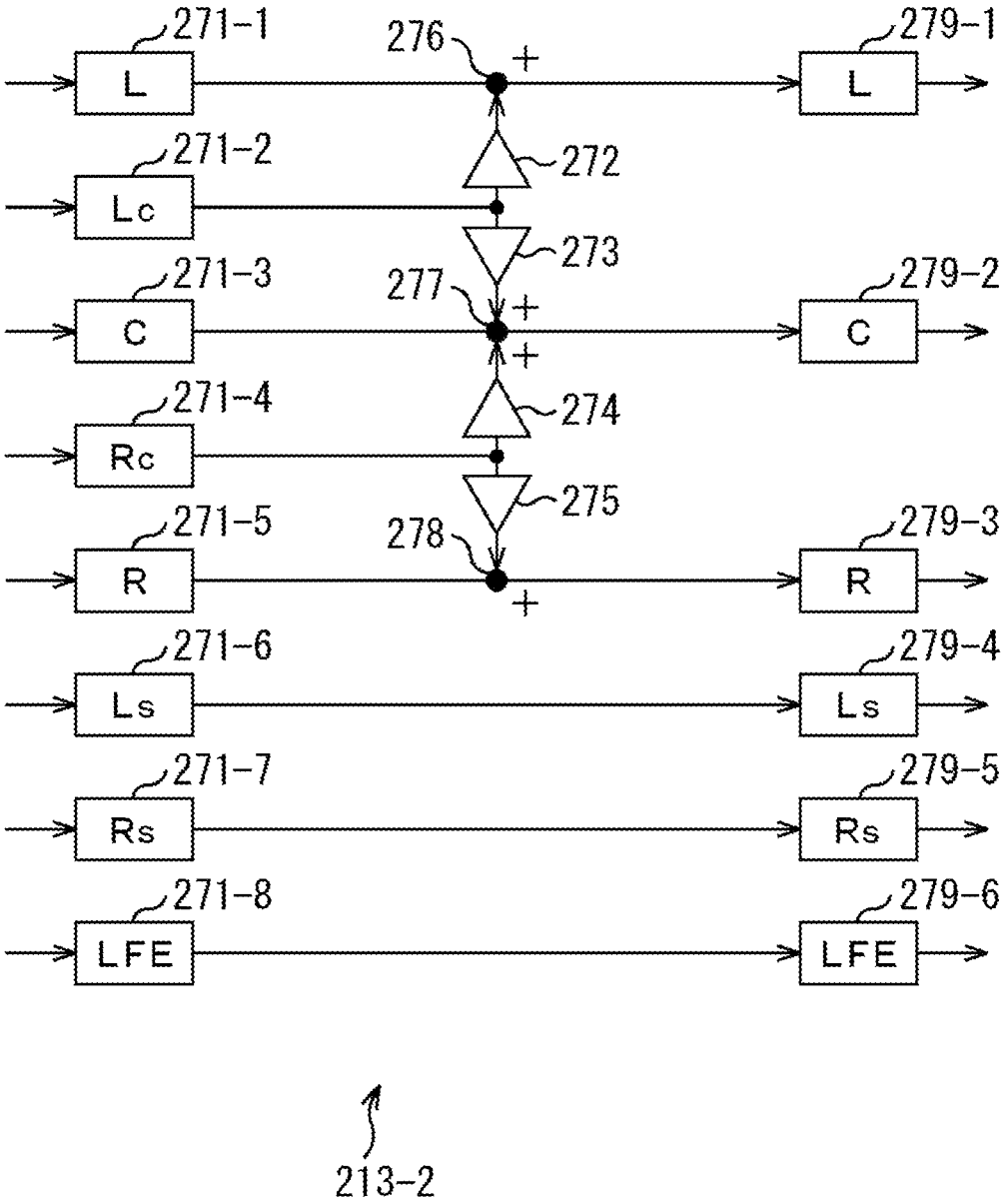
FIG. 31 is a diagram illustrating an example of the structure of a downmixing unit.

FIG. 31 is a diagram illustrating an example of the structure of the downmixing unit 213-2 illustrated in FIG. 29.

The downmixing unit 213-2 includes input terminals 271-1 to 271-8, multiplication units 272 to 275, an addition unit 276, an addition unit 277, an addition unit 278, and output terminals 279-1 to 279-6.

The audio data of the channels L, Lc, C, Rc, R, Ls, Rs, and LFE is supplied from the switching unit 212 to the input terminals 271-1 to 271-8, respectively.

The input terminals 271-1 to 271-5 supply the audio data supplied from the switching unit 212 to the addition unit 276, the multiplication units 272 and 273, the addition unit 277, the multiplication units 274 and 275, and the addition unit 278, respectively.

The multiplication unit 272 and the multiplication unit 273 multiply the audio data supplied from the input terminal 271-2 by a downmix coefficient and supply the audio data to the addition unit 276 and the addition unit 277, respectively. The multiplication unit 274 and the multiplication unit 275 multiply the audio data supplied from the input terminal 271-4 by a downmix coefficient and supply the audio data to the addition unit 277 and the addition unit 278, respectively.

The addition unit 276 adds the audio data supplied from the input terminal 271-1 and the audio data supplied from the multiplication unit 272 and supplies the added audio data to the output terminal 279-1. The output terminal 279-1 supplies the audio data supplied from the addition unit 276 as the audio data of the L channel after downmixing to the switching unit 214.

The addition unit 277 adds the audio data supplied from the input terminal 271-3, the audio data supplied from the multiplication unit 273, and the audio data supplied from the multiplication unit 274 and supplies the added audio data to the output terminal 279-2. The output terminal 279-2 supplies the audio data supplied from the addition unit 277 as the audio data of the C channel after downmixing to the switching unit 214.

The addition unit 278 adds the audio data supplied from the input terminal 271-5 and the audio data supplied from the multiplication unit 275 and supplies the added audio data to the output terminal 279-3. The output terminal 279-3 supplies the audio data supplied from the addition unit 278 as the audio data of the R channel after downmixing to the switching unit 214.

The input terminals 271-6 to 271-8 supply the audio data supplied from the switching unit 212 to the switching unit 214 through the output terminals 279-4 to 279-6, without any change in the audio data. That is, the audio data of the channels Ls, Rs, and LFE supplied from the downmixing unit 213-2 is supplied as the audio data of the channels Ls, Rs, and LFE after downmixing to the next stage, without any change.

Hereinafter, when the input terminals 271-1 to 271-8 do not need to be particularly distinguished from each other, they are simply referred to as input terminals 271. When the output terminals 279-1 to 279-6 do not need to be particularly distinguished from each other, they are simply referred to as output terminals 279.

As such, in the downmixing unit 213-2, a process corresponding to calculation using the above-mentioned Expression (4) is performed.

Figure 32:
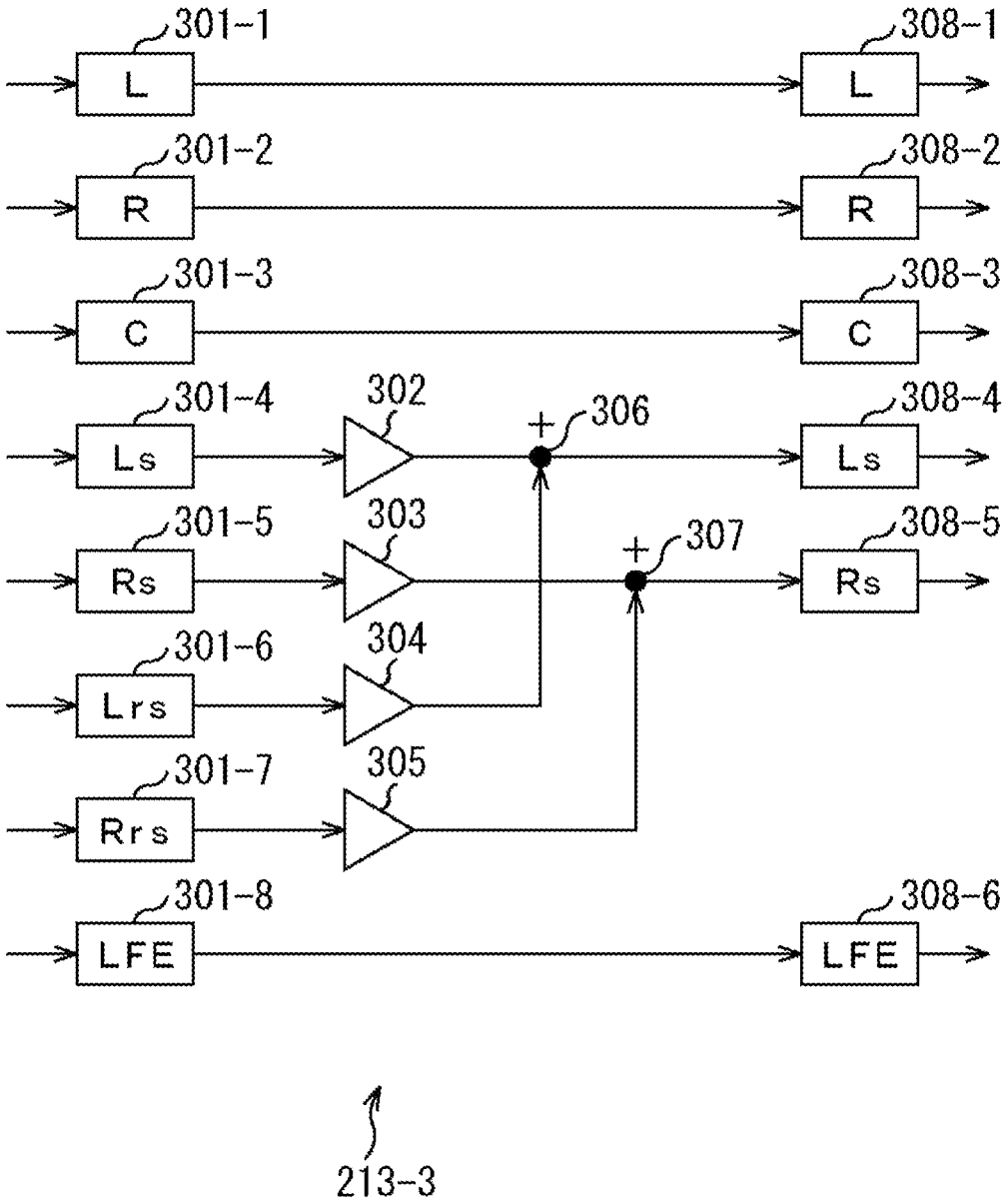
FIG. 32 is a diagram illustrating an example of the structure of a downmixing unit.

FIG. 32 is a diagram illustrating an example of the structure of the downmixing unit 213-3 illustrated in FIG. 29.

The downmixing unit 213-3 includes input terminals 301-1 to 301-8, multiplication units 302 to 305, an addition unit 306, an addition unit 307, and output terminals 308-1 to 308-6.

The audio data of the channels L, R, C, Ls, Rs, Lrs, Rrs, and LFE is supplied from the switching unit 212 to the input terminals 301-1 to 301-8, respectively.

The input terminals 301-1 to 301-3 supply the audio data supplied from the switching unit 212 to the switching unit 214 through the output terminals 308-1 to 308-3, respectively, without any change in the audio data. That is, the audio data of the channels L, R, and C supplied to the downmixing unit 213-3 is output as the audio data of the channels L, R, and C after downmixing to the next stage.

The input terminals 301-4 to 301-7 supply the audio data supplied from the switching unit 212 to the multiplication units 302 to 305, respectively. The multiplication units 302 to 305 multiply the audio data supplied from the input terminals 301-4 to 301-7 by a downmix coefficient and supply the audio data to the addition unit 306, the addition unit 307, the addition unit 306, and the addition unit 307, respectively.

The addition unit 306 adds the audio data supplied from the multiplication unit 302 and the audio data supplied from the multiplication unit 304 and supplies the audio data to the output terminal 308-4. The output terminal 308-4 supplies the audio data supplied from the addition unit 306 as the audio data of the Ls channel after downmixing to the switching unit 214.

The addition unit 307 adds the audio data supplied from the multiplication unit 303 and the audio data supplied from the multiplication unit 305 and supplies the audio data to the output terminal 308-5. The output terminal 308-5 supplies the audio data supplied from the addition unit 307 as the audio data of the Rs channel after downmixing to the switching unit 214.

The input terminal 301-8 supplies the audio data supplied from the switching unit 212 to the switching unit 214 through the output terminal 308-6, without any change in the audio data. That is, the audio data of the LFE channel supplied to the downmixing unit 213-3 is output as the audio data of the LFE channel after downmixing to the next stage, without any change.

Hereinafter, when the input terminals 301-1 to 301-8 do not need to be particularly distinguished from each other, they are simply referred to as input terminals 301. When the output terminals 308-1 to 308-6 do not need to be particularly distinguished from each other, they are simply referred to as output terminals 308.

As such, in the downmixing unit 213-3, a process corresponding to calculation using the above-mentioned Expression (3) is performed.

Figure 33:
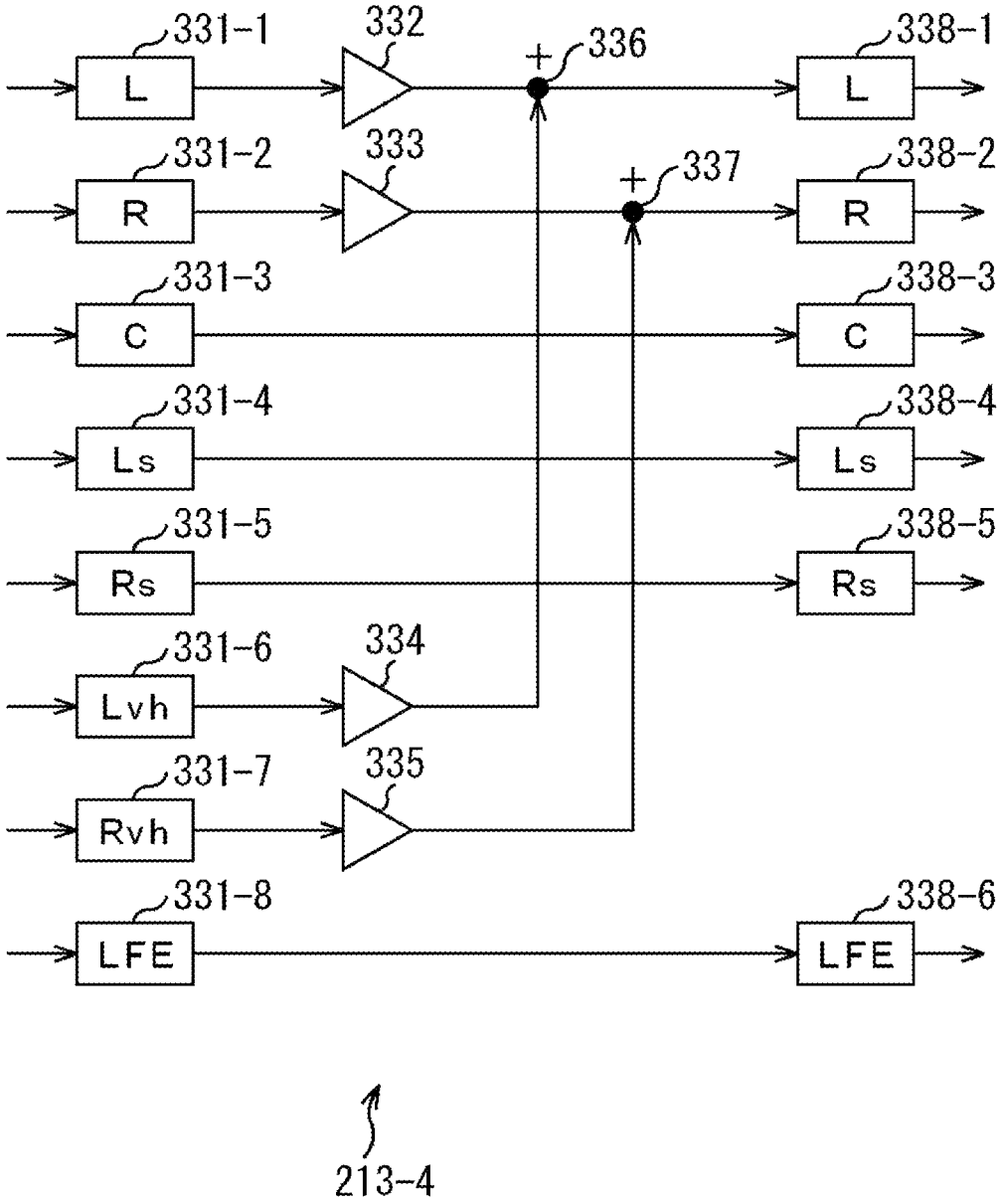
FIG. 33 is a diagram illustrating an example of the structure of a downmixing unit.

FIG. 33 is a diagram illustrating an example of the structure of the downmixing unit 213-4 illustrated in FIG. 29.

The downmixing unit 213-4 includes input terminals 331-1 to 331-8, multiplication units 332 to 335, an addition unit 336, an addition unit 337, and output terminals 338-1 to 338-6.

The audio data of the channels L, R, C, Ls, Rs, Lvh, Rvh, and LFE is supplied from the switching unit 212 to the input terminals 331-1 to 331-8, respectively.

The input terminal 331-1 and the input terminal 331-2 supply the audio data supplied from the switching unit 212 to the multiplication unit 332 and the multiplication unit 333, respectively. The input terminal 331-6 and the input terminal 331-7 supply the audio data supplied from the switching unit 212 to the multiplication unit 334 and the multiplication unit 335, respectively.

The multiplication units 332 to 335 multiply the audio data supplied from the input terminal 331-1, the input terminal 331-2, the input terminal 331-6, and the input terminal 331-7 by a downmix coefficient and supply the audio data to the addition unit 336, the addition unit 337, the addition unit 336, and the addition unit 337, respectively.

The addition unit 336 adds the audio data supplied from the multiplication unit 332 and the audio data supplied from the multiplication unit 334 and supplies the audio data to the output terminal 338-1. The output terminal 338-1 supplies the audio data supplied from the addition unit 336 as the audio data of the L channel after downmixing to the switching unit 214.

The addition unit 337 adds the audio data supplied from the multiplication unit 333 and the audio data supplied from the multiplication unit 335 and supplies the audio data to the output terminal 338-2. The output terminal 338-2 supplies the audio data supplied from the addition unit 337 as the audio data of the R channel after downmixing to the switching unit 214.

The input terminals 331-3 to 331-5 and the input terminal 331-8 supply the audio data supplied from the switching unit 212 to the switching unit 214 through the output terminals 338-3 to 338-5 and the output terminal 338-6, respectively, without any change in the audio data. That is, the audio data of the channels C, Ls, Rs, and LFE supplied to the downmixing unit 213-4 is output as the audio data of the channels C, Ls, Rs, and LFE after downmixing to the next stage, without any change.

Hereinafter, when the input terminals 331-1 to 331-8 do not need to be particularly distinguished from each other, they are simply referred to as input terminals 331. When the output terminals 338-1 to 338-6 do not need to be particularly distinguished from each other, they are simply referred to as output terminals 338.

As such, in the downmixing unit 213-4, a process corresponding to calculation using the above-mentioned Expression (5) is performed.

Then, an example of the detailed structure of the downmixing unit 217 illustrated in FIG. 29 will be described.

Figure 34:
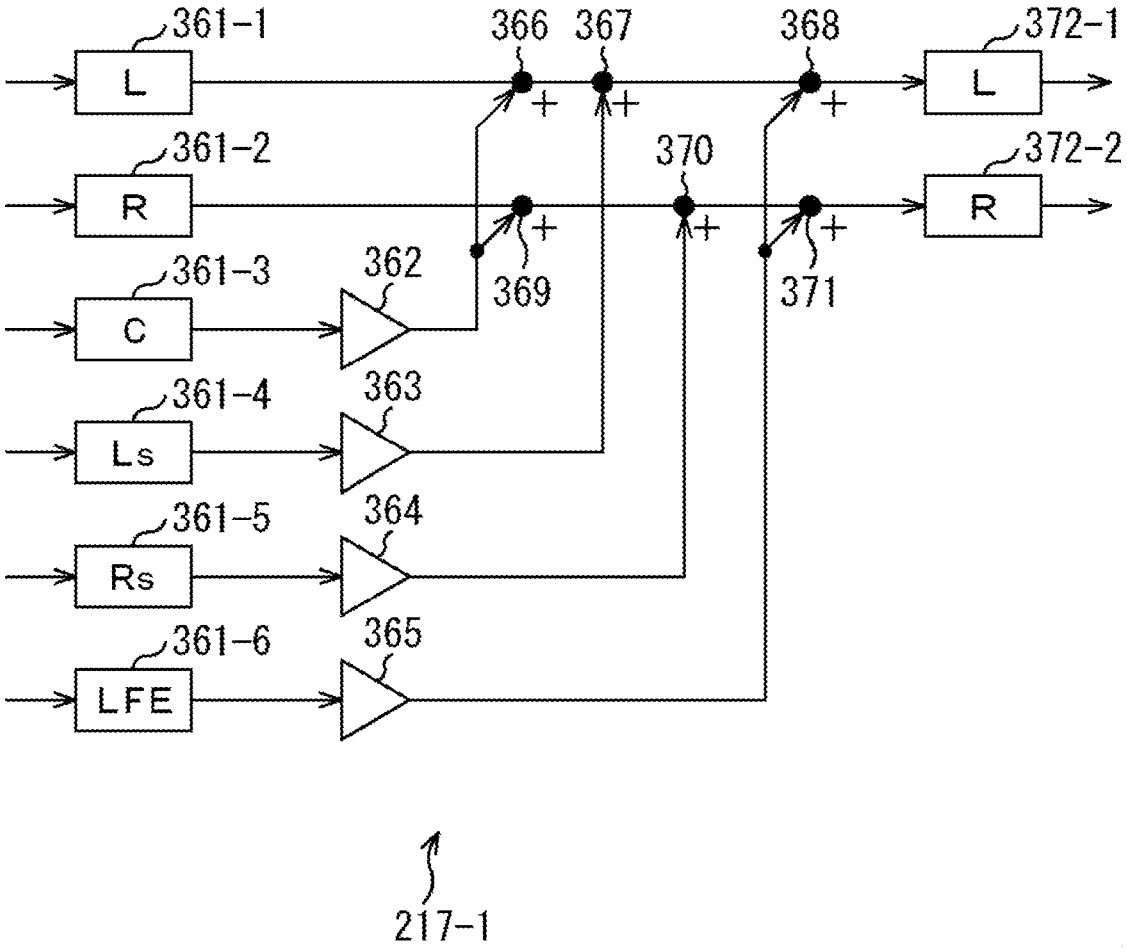
FIG. 34 is a diagram illustrating an example of the structure of a downmixing unit.

FIG. 34 is a diagram illustrating an example of the structure of the downmixing unit 217-1 illustrated in FIG. 29.

The downmixing unit 217-1 includes input terminals 361-1 to 361-6, multiplication units 362 to 365, addition units 366 to 371, an output terminal 372-1, and an output terminal 372-2.

The audio data of the channels L, R, C, Ls, Rs, and LFE is supplied from the switching unit 216 to the input terminals 361-1 to 361-6, respectively.

The input terminals 361-1 to 361-6 supply the audio data supplied from the switching unit 216 to the addition unit 366, the addition unit 369, and the multiplication units 362 to 365, respectively.

The multiplication units 362 to 365 multiply the audio data supplied from the input terminals 361-3 to 361-6 by a downmix coefficient and supply the audio data to the addition units 366 and 369, the addition unit 367, the addition unit 370, and the addition units 368 and 371, respectively.

The addition unit 366 adds the audio data supplied from the input terminal 361-1 and the audio data supplied from the multiplication unit 362 and supplies the added audio data to the addition unit 367. The addition unit 367 adds the audio data supplied from the addition unit 366 and the audio data supplied from the multiplication unit 363 and supplies the added audio data to the addition unit 368.

The addition unit 368 adds the audio data supplied from the addition unit 367 and the audio data supplied from the multiplication unit 365 and supplies the added audio data to the output terminal 372-1. The output terminal 372-1 supplies the audio data supplied from the addition unit 368 as the audio data of the L channel after downmixing to the gain adjustment unit 218.

The addition unit 369 adds the audio data supplied from the input terminal 361-2 and the audio data supplied from the multiplication unit 362 and supplies the added audio data to the addition unit 370. The addition unit 370 adds the audio data supplied from the addition unit 369 and the audio data supplied from the multiplication unit 364 and supplies the added audio data to the addition unit 371.

The addition unit 371 adds the audio data supplied from the addition unit 370 and the audio data supplied from the multiplication unit 365 and supplies the added audio data to the output terminal 372-2. The output terminal 372-2 supplies the audio data supplied from the addition unit 371 as the audio data of the R channel after downmixing to the gain adjustment unit 218.

Hereinafter, when the input terminals 361-1 to 361-6 do not need to be particularly distinguished from each other, they are simply referred to as input terminals 361. When the output terminals 372-1 and 372-2 do not need to be particularly distinguished from each other, they are simply referred to as output terminals 372.

As such, in the downmixing unit 217-1, a process corresponding to calculation using the above-mentioned Expression (1) is performed.

Figure 35:
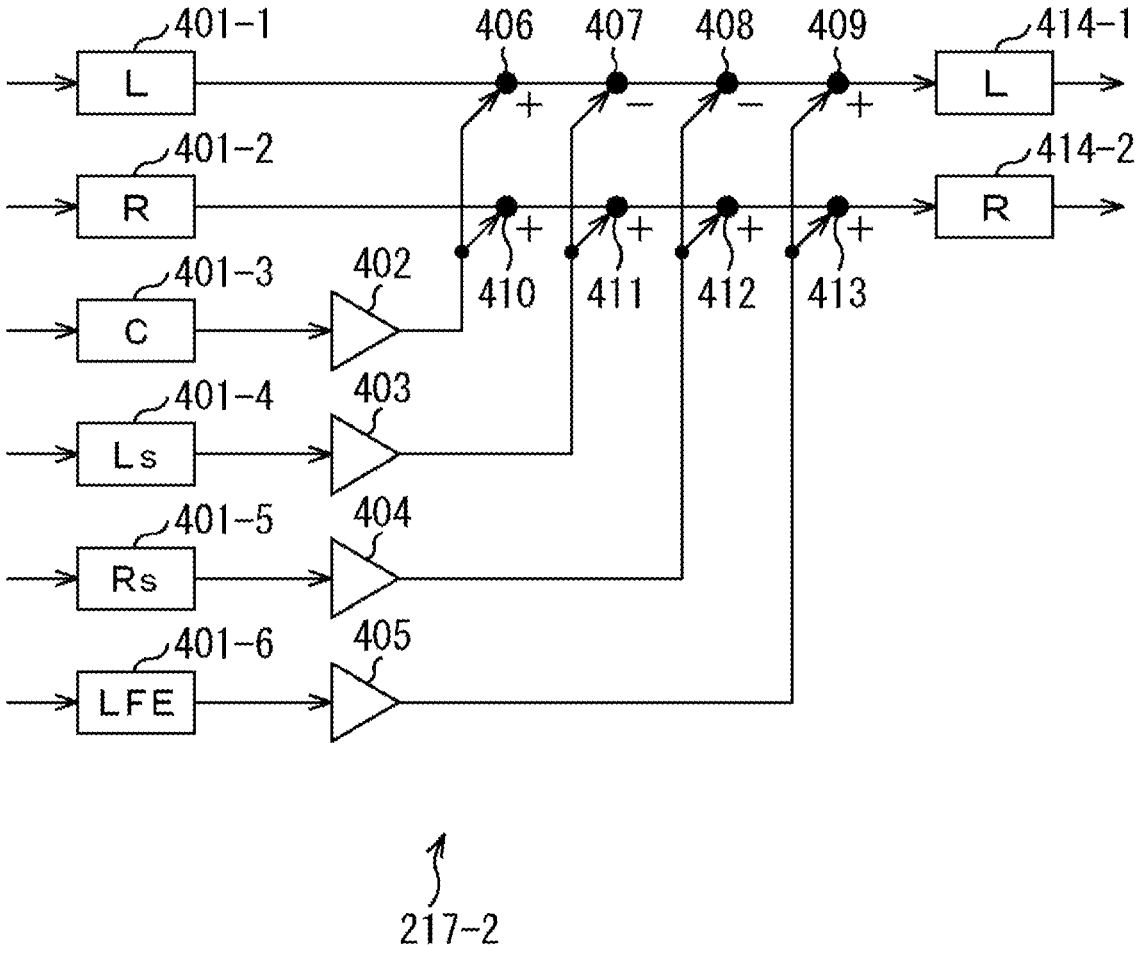
FIG. 35 is a diagram illustrating an example of the structure of a downmixing unit.

FIG. 35 is a diagram illustrating an example of the structure of the downmixing unit 217-2 illustrated in FIG. 29.

The downmixing unit 217-2 includes input terminals 401-1 to 401-6, multiplication units 402 to 405, an addition unit 406, a subtraction unit 407, a subtraction unit 408, addition units 409 to 413, an output terminal 414-1, and an output terminal 414-2.

The audio data of the channels L, R, C, Ls, Rs, and LFE is supplied from the switching unit 216 to the input terminals 401-1 to 401-6, respectively.

The input terminals 401-1 to 401-6 supply the audio data supplied from the switching unit 216 to the addition unit 406, the addition unit 410, and the multiplication units 402 to 405, respectively.

The multiplication units 402 to 405 multiply the audio data supplied from the input terminals 401-3 to 401-6 by a downmix coefficient and supply the audio data to the addition units 406 and 410, the subtraction unit 407 and the addition unit 411, the subtraction unit 408 and the addition unit 412, and the addition units 409 and 413, respectively.

The addition unit 406 adds the audio data supplied from the input terminal 401-1 and the audio data supplied from the multiplication unit 402 and supplies the added audio data to the subtraction unit 407. The subtraction unit 407 subtracts the audio data supplied from the multiplication unit 403 from the audio data supplied from the addition unit 406 and supplies the subtracted audio data to the subtraction unit 408.

The subtraction unit 408 subtracts the audio data supplied from the multiplication unit 404 from the audio data supplied from the subtraction unit 407 and supplies the subtracted audio data to the addition unit 409. The addition unit 409 adds the audio data supplied from the subtraction unit 408 and the audio data supplied from the multiplication unit 405 and supplies the added audio data to the output terminal 414-1. The output terminal 414-1 supplies the audio data supplied from the addition unit 409 as the audio data of the L channel after downmixing to the gain adjustment unit 218.

The addition unit 410 adds the audio data supplied from the input terminal 401-2 and the audio data supplied from the multiplication unit 402 and supplies the added audio data to the addition unit 411. The addition unit 411 adds the audio data supplied from the addition unit 410 and the audio data supplied from the multiplication unit 403 and supplies the added audio data to the addition unit 412.

The addition unit 412 adds the audio data supplied from the addition unit 411 and the audio data supplied from the multiplication unit 404 and supplies the added audio data to the addition unit 413. The addition unit 413 adds the audio data supplied from the addition unit 412 and the audio data supplied from the multiplication unit 405 and supplies the added audio data to the output terminal 414-2. The output terminal 414-2 supplies the audio data supplied from the addition unit 413 as the audio data of the R channel after downmixing to the gain adjustment unit 218.

Hereinafter, when the input terminals 401-1 to 401-6 do not need to be particularly distinguished from each other, they are simply referred to as input terminals 401. When the output terminals 414-1 and 414-2 do not need to be particularly distinguished from each other, they are simply referred to as output terminals 414.

As such, in the downmixing unit 217-2, a process corresponding to calculation using the above-mentioned Expression (2) is performed.

[Description of a Decoding Operation]

Figure 36:
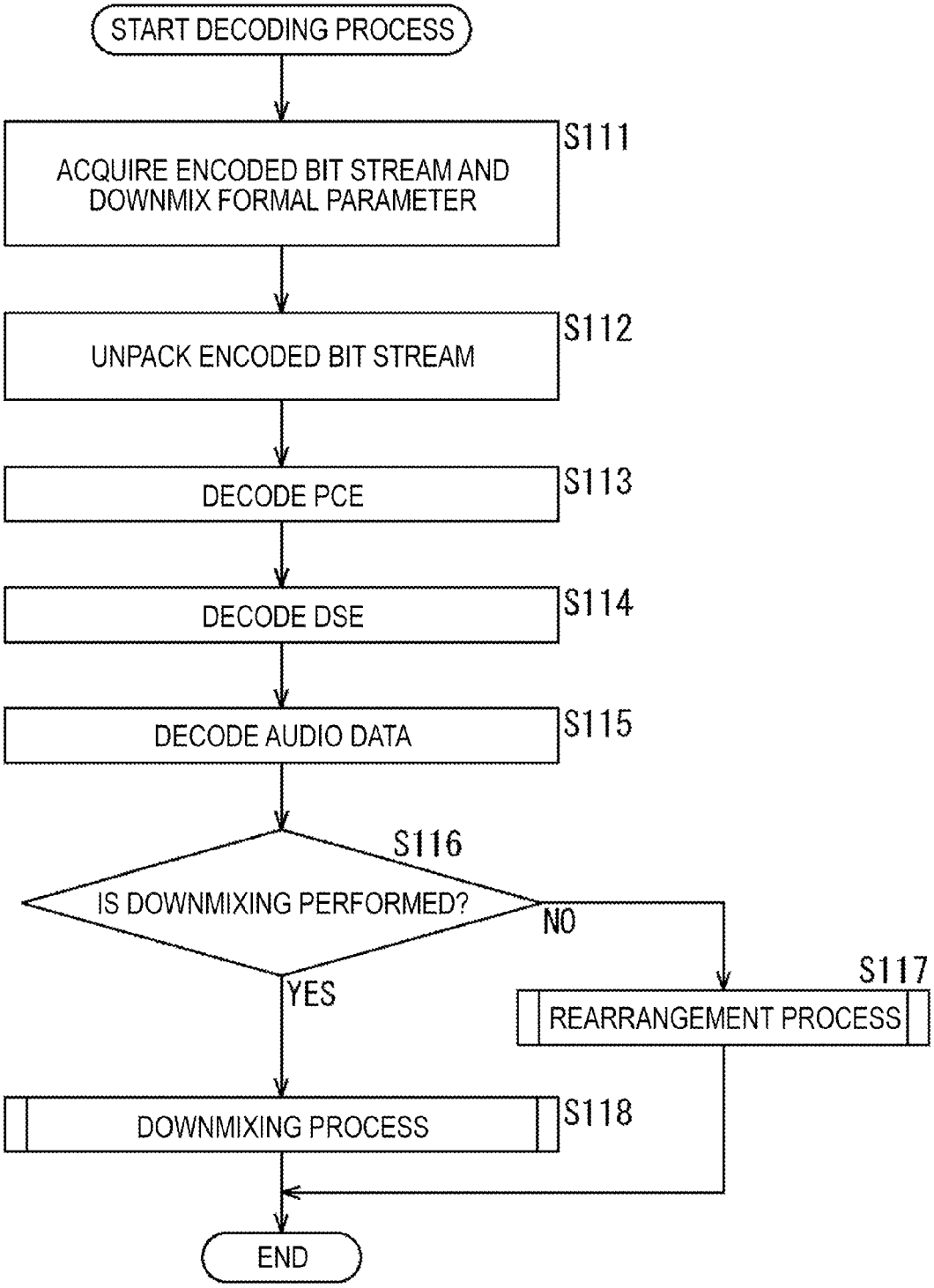
FIG. 36 is a flowchart illustrating a decoding process.

Next, a decoding process of the decoding device 141 will be described with reference to the flowchart illustrated in FIG. 36.

In Step S111, the separation unit 61 acquires the downmix formal parameter and the encoded bit stream output from the encoding device 91. For example, the downmix formal parameter is acquired from an information processing device including the decoding device.

The separation unit 61 supplies the acquired downmix formal parameter to the switching unit 151 and the downmix processing unit 152. In addition, the separation unit 61 acquires the output file name of audio data and appropriately uses the output file name, if necessary.

In Step S112, the separation unit 61 unpacks the encoded bit stream and supplies each element obtained by the unpacking to the decoding unit 62.

In Step S113, the PCE decoding unit 161 decodes the PCE supplied from the separation unit 61. For example, the PCE decoding unit 161 reads "height_extension_element", which is an extended region, from the comment region of the PCE or reads information about the arrangement of the speakers from the PCE. Here, as the information about the arrangement of the speakers, for example, the number of channels reproduced by the speakers which are arranged on the front, side, and rear of the user or information indicating to which of the C, L, and R channels each audio data item belongs.

In Step S114, the DSE decoding unit 162 decodes the DSE supplied from the separation unit 61. For example, the DSE decoding unit 162 reads "MPEG4 ancillary data" from the DSE or reads necessary information from "MPEG4 ancillary data".

Specifically, for example, the downmix information decoding unit 174 of the DSE decoding unit 162 reads "center_mix_level_value" or "surround_mix_level_value" as information for specifying the coefficient used for downmixing from "downmixing_levels_MPEG4( )" illustrated in FIG. 9 and supplies the read information to the downmix processing unit 152.

In Step S115, the audio element decoding unit 163 decodes the audio data stored in each of the SCE, CPE, and LFE supplied from the separation unit 61. In this way, PCM data of each channel is obtained as audio data.

For example, the channel of the decoded audio data, that is, an arrangement position on the horizontal plane can be specified by an element, such as the SCE storing the audio data, or information about the arrangement of the speakers which is obtained by the decoding of the DSE. However, at that time, since the speaker arrangement information, which is information about the arrangement height of the speakers, is not read, the height (layer) of each channel is not specified.

The audio element decoding unit 163 supplies the audio data obtained by decoding to the switching unit 151.

In Step S116, the switching unit 151 determines whether to downmix audio data on the basis of the downmix formal parameter supplied from the separation unit 61. For example, when the downmix formal parameter indicates that downmixing is not performed, the switching unit 151 determines not to perform downmixing.

In Step S116, when it is determined that downmixing is not performed, the switching unit 151 supplies the audio data supplied from the decoding unit 62 to the rearrangement processing unit 181 and the process proceeds to Step S117.

In Step S117, the decoding device 141 performs a rearrangement process to rearrange each audio data item on the basis of the arrangement of the speakers and outputs the audio data. When the audio data is output, the decoding process ends. In addition, the rearrangement process will be described in detail below.

On the other hand, when it is determined in Step S116 that downmixing is performed, the switching unit 151 supplies the audio data supplied from the decoding unit 62 to the switching unit 211 of the downmix processing unit 152 and the process proceeds to Step S118.

In Step S118, the decoding device 141 performs a downmixing process to downmix each audio data item to audio data corresponding to the number of channels which is indicated by the downmix formal parameter and outputs the audio data. When the audio data is output, the decoding process ends. In addition, the downmixing process will be described in detail below.

In this way, the decoding device 141 decodes the encoded bit stream and outputs audio data.

[Description of Rearrangement Process]

Figure 37:
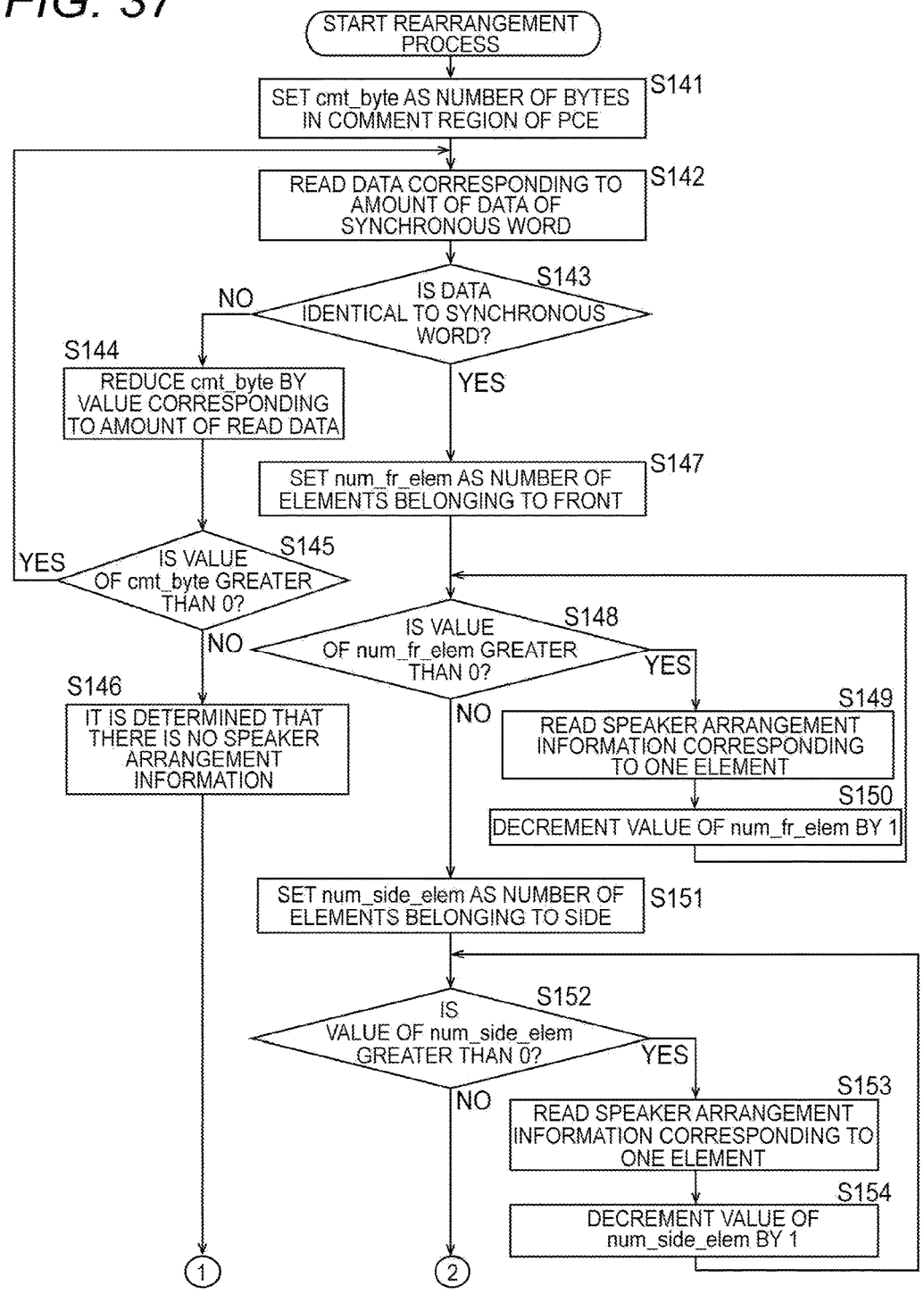
FIG. 37 is a flowchart illustrating a rearrangement process.
Figure 38:
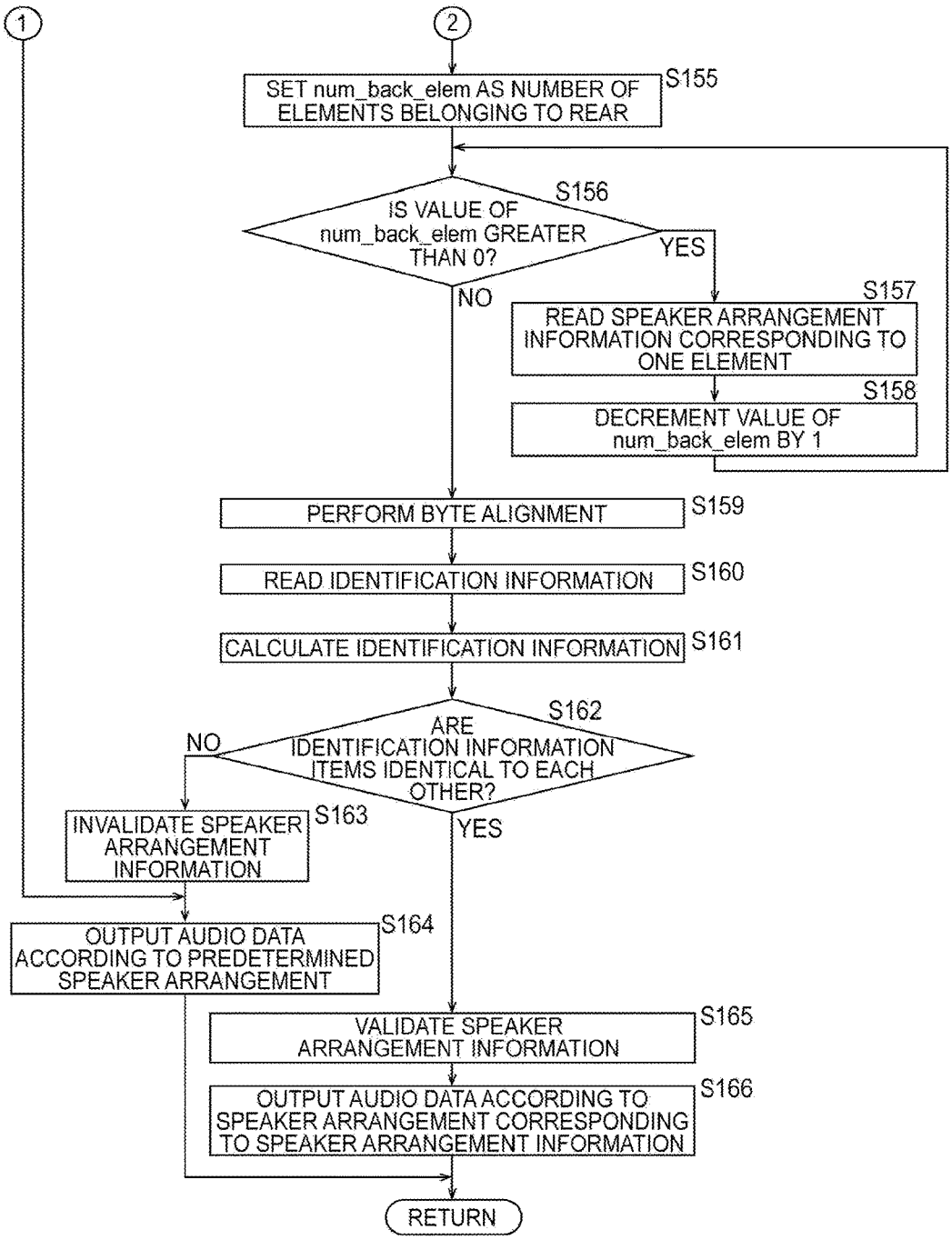
FIG. 38 is a flowchart illustrating the rearrangement process.

Next, a rearrangement process corresponding to the process in Step S117 of FIG. 36 will be described with reference to the flowcharts illustrated in FIGS. 37 and 38.

In Step S141, the synchronous word detection unit 171 sets a parameter cmt_byte for reading the synchronous word from the comment region (extended region) of the PCE such that cmt_byte is equal to the number of bytes in the comment region of the PCE. That is, the number of bytes in the comment region is set as the value of the parameter cmt_byte.

In Step S142, the synchronous word detection unit 171 reads data corresponding to the amount of data of a predetermined synchronous word from the comment region of the PCE. For example, in the example illustrated in FIG. 4, since "PCE_HEIGHT_EXTENSION_SYNC", which is the synchronous word, is 8 bits, that is, 1 byte, 1-byte data is read from the head of the comment region of the PCE.

In Step S143, the PCE decoding unit 161 determines whether the data read in Step S142 is identical to the synchronous word. That is, it is determined whether the read data is the synchronous word.

When it is determined in Step S143 that the read data is not identical to the synchronous word, the synchronous word detection unit 171 reduces the value of the parameter cmt_byte by a value corresponding to the amount of read data in Step S144. In this case, the value of the parameter cmt_byte is reduced by 1 byte.

In Step S145, the synchronous word detection unit 171 determines whether the value of the parameter cmt_byte is greater than 0. That is, it is determined whether the value of the parameter cmt_byte is greater than 0, that is, whether all data in the comment region is read.

When it is determined in Step S145 that the value of the parameter cmt_byte is greater than 0, not all data is read from the comment region and the process returns to Step S142. Then, the above-mentioned process is repeated. That is, data corresponding to the amount of data of the synchronous word is read following the data read from the comment region and is compared with the synchronous word.

On the other hand, when it is determined in Step S145 that the value of the parameter cmt_byte is not greater than 0, the process proceeds to Step S146. As such, the process proceeds to Step S146 when all data in the comment region is read, but no synchronous word is detected from the comment region.

In Step S146, the PCE decoding unit 161 determines that there is no speaker arrangement information and supplies information indicating that there is no speaker arrangement information to the rearrangement processing unit 181. The process proceeds to Step S164. As such, since the synchronous word is arranged immediately before the speaker arrangement information in "height_extension_element", it is possible to simply and reliably specify whether information included in the comment region is the speaker arrangement information.

When it is determined in Step S143 that the data read from the comment region is identical to the synchronous word, the synchronous word is detected. Therefore, the process proceeds to Step S147 in order to read the speaker arrangement information immediately after the synchronous word.

In Step S147, the PCE decoding unit 161 sets the value of a parameter num_fr_elem for reading the speaker arrangement information of the audio data reproduced by the speaker which is arranged in front of the user as the number of elements belonging to the front.

Here, the number of elements belonging to the front is the number of audio data items (the number of channels) reproduced by the speaker which is arranged in front of the user. The number of elements is stored in the PCE. Therefore, the value of the parameter num_fr_elem is the number of speaker arrangement information items of the audio data which is read from "height_extension_element" and is reproduced by the speaker that is arranged in front of the user.

In Step S148, the PCE decoding unit 161 determines whether the value of the parameter num_fr_elem is greater than 0.

When it is determined in Step S148 that the value of the parameter num_fr_elem is greater than 0, the process proceeds to Step S149 since all of the speaker arrangement information is not read.

In Step S149, the PCE decoding unit 161 reads the speaker arrangement information corresponding to one element which is arranged following the synchronous word in the comment region. In the example illustrated in FIG. 4, since one speaker arrangement information item is 2 bits, 2-bit data which is arranged immediately after the data read from the comment region is read as one speaker arrangement information item.

It is possible to specify each speaker arrangement information item about audio data on the basis of, for example, the arrangement position of the speaker arrangement information in "height_extension_element" or the element storing audio data, such as the SCE.

In Step S150, since one speaker arrangement information item is read, the PCE decoding unit 161 decrements the value of the parameter num_fr_elem by 1. After the parameter num_fr_elem is updated, the process returns to Step S148 and the above-mentioned process is repeated. That is, the next speaker arrangement information is read.

When it is determined in Step S148 that the value of the parameter num_fr_elem is not greater than 0, the process proceeds to Step S151 since all of the speaker arrangement information about the front element has been read.

In Step S151, the PCE decoding unit 161 sets the value of a parameter num_side_elem for reading the speaker arrangement information of the audio data reproduced by the speaker which is arranged at the side of the user as the number of elements belonging to the side.

Here, the number of elements belonging to the side is the number of audio data items reproduced by the speaker which is arranged at the side of the user. The number of elements is stored in the PCE.

In Step S152, the PCE decoding unit 161 determines whether the value of the parameter num_side_elem is greater than 0.

When it is determined in Step S152 that the value of the parameter num_side_elem is greater than 0, the PCE decoding unit 161 reads speaker arrangement information which corresponds to one element and is arranged following the data read from the comment region in Step S153. The speaker arrangement information read in Step S153 is the speaker arrangement information of the channel which is at the side of the user, that is, "side_element_height_info[i]".

In Step S154, the PCE decoding unit 161 decrements the value of the parameter num_side_elem by 1. After the parameter num_side_elem is updated, the process returns to Step S152 and the above-mentioned process is repeated.

On the other hand, when it is determined in Step S152 that the value of the parameter num_side_elem is not greater than 0, the process proceeds to Step S155 since all of the speaker arrangement information of the side element has been read.

In Step S155, the PCE decoding unit 161 sets the value of a parameter num_back_elem for reading the speaker arrangement information of the audio data reproduced by the speaker which is arranged at the rear of the user as the number of elements belonging to the rear.

Here, the number of elements belonging to the rear is the number of audio data items reproduced by the speaker which is arranged at the rear of the user. The number of elements is stored in the PCE.

In Step S156, the PCE decoding unit 161 determines whether the value of the parameter num_back_elem is greater than 0.

When it is determined in Step S156 that the value of the parameter num_back_elem is greater than 0, the PCE decoding unit 161 reads speaker arrangement information which corresponds to one element and is arranged following the data read from the comment region in Step S157. The speaker arrangement information read in Step S157 is the speaker arrangement information of the channel which is arranged on the rear of the user, that is, "back_element_height_info[i]".

In Step S158, the PCE decoding unit 161 decrements the value of the parameter num_back_elem by 1. After the parameter num_back_elem is updated, the process returns to Step S156 and the above-mentioned process is repeated.

When it is determined in Step S156 that the value of the parameter num_back_elem is not greater than 0, the process proceeds to Step S159 since all of the speaker arrangement information about the rear element has been read.

In Step S159, the identification information calculation unit 172 performs byte alignment.

For example, information "byte_alignment( )" for instructing the execution of byte alignment is stored following the speaker arrangement information in "height_extension_element" illustrated in FIG. 4. Therefore, when this information is read, the identification information calculation unit 172 performs the byte alignment.

Specifically, the identification information calculation unit 172 adds predetermined data immediately after information which is read between "PCE_HEIGHT_EXTENSION_SYNC" and "byte_alignment( )" in "height_extension_element" such that the amount of data of the read information is an integer multiple of 8 bits. That is, the byte alignment is performed such that the total amount of data of the read synchronous word, the speaker arrangement information, and the added data is an integer multiple of 8 bits.

In this example, the number of channels of audio data, that is, the number of speaker arrangement information items included in the encoded bit stream is within a predetermined range. Therefore, the data obtained by the byte alignment, that is, one data item (hereinafter, also referred to as alignment data) including the synchronous word, the speaker arrangement information, and the added data is certainly a predetermined amount of data.

In other words, the amount of alignment data is certainly a predetermined amount of data, regardless of the number of speaker arrangement information items included in "height_extension_element", that is, the number of channels of audio data. Therefore, if the amount of alignment data is not a predetermined amount of data at the time when the alignment data is generated, the PCE decoding unit 161 determines that the read speaker arrangement information is not correct speaker arrangement information, that is, the read speaker arrangement information is invalid.

In Step S160, the identification information calculation unit 172 reads identification information which follows "byte_alignment( )" read in Step S159, that is, information stored in "height_info_crc_check" in "height_extension_element". Here, for example, a CRC check code is read as the identification information.

In Step S161, the identification information calculation unit 172 calculates identification information on the basis of the alignment data obtained in Step S159. For example, a CRC check code is calculated as the identification information.

In Step S162, the PCE decoding unit 161 determines whether the identification information read in Step S160 is identical to the identification information calculated in Step S161.

When the amount of alignment data is not a predetermined amount of data, the PCE decoding unit 161 does not perform Step S160 and Step S161 and determines that the identification information items are not identical to each other in Step S162.

When it is determined in Step S162 that the identification information items are not identical to each other, the PCE decoding unit 161 invalidates the read speaker arrangement information and supplies information indicating that the read speaker arrangement information is invalid to the rearrangement processing unit 181 and the downmix processing unit 152 in Step S163. Then, the process proceeds to Step S164.

When the process in Step S163 or the process in Step S146 is performed, the rearrangement processing unit 181 outputs the audio data supplied from the switching unit 151 in predetermined speaker arrangement in Step S164.

In this case, for example, the rearrangement processing unit 181 determines the speaker arrangement of each audio data item on the basis of the information about speaker arrangement which is read from the PCE and is supplied from the PCE decoding unit 161. The reference destination of information which is used by the rearrangement processing unit 181 to determine the arrangement of the speakers depends on the service or application using audio data and is predetermined on the basis of the number of channels of audio data.

When the process in Step S164 is performed, the rearrangement process ends. Then, the process in Step S117 of FIG. 36 ends. Therefore, the decoding process ends.

On the other hand, when it is determined in Step S162 that the identification information items are identical to each other, the PCE decoding unit 161 validates the read speaker arrangement information and supplies the speaker arrangement information to the rearrangement processing unit 181 and the downmix processing unit 152 in Step S165. In this case, the PCE decoding unit 161 also supplies information about the arrangement of the speakers read from the PCE to the rearrangement processing unit 181 and the downmix processing unit 152.

In Step S166, the rearrangement processing unit 181 outputs the audio data supplied from the switching unit 151 according to the arrangement of the speakers which is determined by, for example, the speaker arrangement information supplied from the PCE decoding unit 161. That is, the audio data of each channel is rearranged in the order which is determined by, for example, the speaker arrangement information and is then output to the next stage. When the process in Step S166 is performed, the rearrangement process ends. Then, the process in Step S117 illustrated in FIG. 36 ends. Therefore, the decoding process ends.

In this way, the decoding device 141 checks the synchronous word or the CRC check code from the comment region of the PCE, reads the speaker arrangement information, and outputs the decoded audio data according to arrangement corresponding to the speaker arrangement information.

As such, since the speaker arrangement information is read and the arrangement of the speakers (the position of sound sources) is determined, it is possible to reproduce a sound image in the vertical direction and obtain a high-quality realistic sound.

In addition, since the speaker arrangement information is read using the synchronous word and the CRC check code, it is possible to reliably read the speaker arrangement information from the comment region in which, for example, other text information is likely to be stored. That is, it is possible to reliably distinguish the speaker arrangement information and other information.

In particular, the decoding device 141 distinguishes the speaker arrangement information and other information using three elements, that is, an identity of the synchronous words, an identity of the CRC check codes, and an identity of the amounts of alignment data. Therefore, it is possible to prevent errors in the detection of the speaker arrangement information. As such, since errors in the detection of the speaker arrangement information are prevented, it is possible to reproduce audio data according to the correct arrangement of the speakers and obtain a high-quality realistic sound.

[Description of Downmixing Process]

Next, a downmixing process corresponding to the process in Step S118 of FIG. 36 will be described with reference to the flowchart illustrated in FIG. 39. In this case, the audio data of each channel is supplied from the switching unit 151 to the switching unit 211 of the downmix processing unit 152.

In Step S191, the extension detection unit 173 of the DSE decoding unit 162 reads "ancillary_data_extension_status" from "ancillary_data_status( )" in "MPEG4_ancillary_data( )" of the DSE.

In Step S192, the extension detection unit 173 determines whether the read "ancillary_data_extension_status" is 1.

When it is determined in Step S192 that "ancillary_data_extension_status" is not 1, that is, "ancillary_data_extension_status" is 0, the downmix processing unit 152 downmixes audio data using a predetermined method in Step S193.

For example, the downmix processing unit 152 downmixes the audio data supplied from the switching unit 151 using a coefficient which is determined by "center_mix_level_value" or "surround_mix_level_value" supplied from the downmix information decoding unit 174 and supplies the audio data to the output unit 63.

When "ancillary_data_extension_status" is 0, the downmixing process may be performed by any method.

In Step S194, the output unit 63 outputs the audio data supplied from the downmix processing unit 152 to the next stage, without any change in the audio data. Then, the downmixing process ends. In this way, the process in Step S118 of FIG. 36 ends. Therefore, the decoding process ends.

On the other hand, when it is determined in Step S192 that "ancillary_data_extension_status" is 1, the process proceeds to Step S195.

In Step S195, the downmix information decoding unit 174 reads information in "ext_downmixing_levels( )" of "MPEG4_ext_ancillary_data( )" illustrated in FIG. 11 and supplies the read information to the downmix processing unit 152. In this way, for example, "dmix_a_idx" and "dmix_b_idx" illustrated in FIG. 13 are read.

When "ext_downmixing_levels_status" illustrated in FIG. 12 which is included in "MPEG4_ext_ancillary_data( )" is 0, the reading of "dmix_a_idx" and "dmix_b_idx" is not performed.

In Step S196, the downmix information decoding unit 174 reads information in "ext_downmixing_global_gains( )" of "MPEG4_ext_ancillary_data( )" and outputs the read information to the downmix processing unit 152. In this way, for example, the information items illustrated in FIG. 15, that is, "dmx_gain_5_sign", "dmx_gain_5_idx", "dmx_gain_2_sign", and "dmx_gain_2_idx" are read.

The reading of the information items is not performed when "ext_downmixing_global_gains_status" illustrated in FIG. 12 which is included in "MPEG4_ext_ancillary_data( )" is 0.

In Step S197, the downmix information decoding unit 174 reads information in "ext_downmixing_lfe_level( )" of "MPEG4_ext_ancillary_data( )" and supplies the read information to the downmix processing unit 152. In this way, for example, "dmix_lfe_idx" illustrated in FIG. 16 is read.

Specifically, the downmix information decoding unit 174 reads "ext_downmixing_lfe_level_status" illustrated in FIG. 12 and reads "dmix_lfe_idx" on the basis of the value of "ext_downmixing_lfe_level_status".

That is, the reading of "dmix_lfe_idx" is not performed when "ext_downmixing_lfe_level_status" included in "MPEG4_ext_ancillary_data( )" is 0. In this case, the audio data of the LFE channel is not used in the downmixing of audio data from 5.1 channels to 2 channels, which will be described below. That is, the coefficient multiplied by the audio data of the LFE channel is 0.

In Step S198, the downmix information decoding unit 174 reads information stored in "pseudo_surround_enable" from "bs_info( )" of "MPEG4 ancillary data" illustrated in FIG. 7 and supplies the read information to the downmix processing unit 152.

In Step S199, the downmix processing unit 152 determines whether the audio data is an output from 2 channels on the basis of the downmix formal parameter supplied from the separation unit 61.

For example, when the downmix formal parameter indicates downmixing from 7.1 channels or 6.1 channels to 2 channels or downmixing from 5.1 channels to 2 channels, it is determined that the audio data is an output from 2 channels.

When it is determined in Step S199 that the audio data is an output from 2 channels, the process proceeds to Step S200. In this case, the output destination of the switching unit 214 is changed to the switching unit 216.

In Step S200, the downmix processing unit 152 determines whether the input of audio data is 5.1 channels on the basis of the downmix formal parameter supplied from the separation unit 61. For example, when the downmix formal parameter indicates downmixing from 5.1 channels to 2 channels, it is determined that the input is 5.1 channels.

When it is determined in Step S200 that the input is not 5.1 channels, the process proceeds to Step S201 and downmixing from 7.1 channels or 6.1 channels to 2 channels is performed.

In this case, the switching unit 211 supplies the audio data supplied from the switching unit 151 to the switching unit 212. The switching unit 212 supplies the audio data supplied from the switching unit 211 to any one of the downmixing units 213-1 to 213-4 on the basis of the information about speaker arrangement which is supplied from the PCE decoding unit 161. For example, when the audio data is data of 6.1 channels, the audio data of each channel is supplied to the downmixing unit 213-1.

In Step S201, the downmixing unit 213 performs downmixing to 5.1 channels on the basis of "dmix_a_idx" and "dmix_b_idx" which is read "ext_downmixing_levels( )" and is supplied from the downmix information decoding unit 174.

For example, when the audio data is supplied to the downmixing unit 213-1, the downmixing unit 213-1 sets constants which are determined for the values of "dmix_a_idx" and "dmix_b_idx" as constants g1 and g2 with reference to the table illustrated in FIG. 19, respectively. Then, the downmixing unit 213-1 uses the constants g1 and g2 as coefficients which are used in the multiplication units 242 and 243 and the multiplication unit 244, respectively, generates audio data of 5.1 channels using Expression (6), and supplies the audio data to the switching unit 214.

Similarly, when the audio data is supplied to the downmixing unit 213-2, the downmixing unit 213-2 sets the constants which are determined for the values of "dmix_a_idx" and "dmix_b_idx" as constants e1 and e2, respectively. Then, the downmixing unit 213-2 uses the constants e1 and e2 as coefficients which are used in the multiplication units 273 and 274, and the multiplication units 272 and 275, respectively, generates audio data of 5.1 channels using Expression (4), and supplies the obtained audio data of 5.1 channels to the switching unit 214.

When the audio data is supplied to the downmixing unit 213-3, the downmixing unit 213-3 sets constants which are determined for the values of "dmix_a_idx" and "dmix_b_idx" as constants d1 and d2, respectively. Then, the downmixing unit 213-3 uses the constants d1 and d2 as coefficients which are used in the multiplication units 302 and 303, and the multiplication units 304 and 305, respectively, generates audio data using Expression (3), and supplies the obtained audio data to the switching unit 214.

When the audio data is supplied to the downmixing unit 213-4, the downmixing unit 213-4 sets the constants which are determined for the values of "dmix_a_idx" and "dmix_b_idx" as constants f1 and f2, respectively. Then, the downmixing unit 213-4 uses the constants f1 and f2 as coefficients which are used in the multiplication units 332 and 333, and the multiplication units 334 and 335, generates audio data using Expression (5), and supplies the obtained audio data to the switching unit 214.

When the audio data of 5.1 channels is supplied to the switching unit 214, the switching unit 214 supplies the audio data supplied from the downmixing unit 213 to the switching unit 216. The switching unit 216 supplies the audio data supplied from the switching unit 214 to the downmixing unit 217-1 or the downmixing unit 217-2 on the basis of the value of "pseudo_surround_enable" supplied from the downmix information decoding unit 174.

For example, when the value of "pseudo_surround_enable" is 0, the audio data is supplied to the downmixing unit 217-1. When the value of "pseudo_surround_enable" is 1, the audio data is supplied to the downmixing unit 217-2.

In Step S202, the downmixing unit 217 performs a process of downmixing the audio data supplied from the switching unit 216 to 2 channels on the basis of the information about downmixing which is supplied from the downmix information decoding unit 174. That is, downmixing to 2 channels is performed on the basis of information in "downmixing_levels_MPEG4( )" and information in "ext_downmixing_lfe_level( )".

For example, when the audio data is supplied to the downmixing unit 217-1, the downmixing unit 217-1 sets the constants which are determined for the values of "center_mix_level_value" and "surround_mix_level_value" as constants a and b with reference to the table illustrated in FIG. 19, respectively. In addition, the downmixing unit 217-1 sets the constant which is determined for the value of "dmix_lfe_idx" as a constant c with reference to the table illustrated in FIG. 18.

Then, the downmixing unit 217-1 uses the constants a, b, and c as coefficients which are used in the multiplication units 363 and 364, the multiplication unit 362, and the multiplication unit 365, respectively, generates audio data using Expression (1), and supplies the obtained audio data of 2 channels to the gain adjustment unit 218.

When the audio data is supplied to the downmixing unit 217-2, the downmixing unit 217-2 determines the constants a, b, and c, similarly to the downmixing unit 217-1. Then, the downmixing unit 217-2 uses the constants a, b, and c as coefficients which are used in the multiplication units 403 and 404, the multiplication unit 402, and the multiplication unit 405, respectively, generates audio data using Expression (2), and supplies the obtained audio data to the gain adjustment unit 218.

In Step S203, the gain adjustment unit 218 adjusts the gain of the audio data from the downmixing unit 217 on the basis of the information which is read from "ext_downmixing_global_gains( )" and is supplied from the downmix information decoding unit 174.

Specifically, the gain adjustment unit 218 calculates Expression (11) on the basis of "dmx_gain_5_sign", "dmx_gain_5_idx", "dmx_gain_2_sign", and "dmx_gain_2_idx" which are read from "ext_downmixing_global_gains( )" and calculates a gain value dmx_gain_7to2. Then, the gain adjustment unit 218 multiplies the audio data of each channel by the gain value dmx_gain_7to2 and supplies the audio data to the output unit 63.

In Step S204, the output unit 63 outputs the audio data supplied from the gain adjustment unit 218 to the next stage, without any change in the audio data. Then, the downmixing process ends. In this way, the process in Step S118 of FIG. 36 ends. Therefore, the decoding process ends.

The audio data is output from the output unit 63 when the audio data is output from the rearrangement processing unit 181 and when the audio data is output from the downmix processing unit 152 without any change. In the stage after the output unit 63, one of the two outputs of the audio data to be used can be predetermined.

When it is determined in Step S200 that the input is 5.1 channels, the process proceeds to Step S205 and downmixing from 5.1 channels to 2 channels is performed.

In this case, the switching unit 211 supplies the audio data supplied from the switching unit 151 to the switching unit 216. The switching unit 216 supplies the audio data supplied from the switching unit 211 to the downmixing unit 217-1 or the downmixing unit 217-2 on the basis of the value of "pseudo_surround_enable" supplied from the downmix information decoding unit 174.

In Step S205, the downmixing unit 217 performs a process of downmixing the audio data supplied from the switching unit 216 to 2 channels on the basis of the information about downmixing which is supplied from the downmix information decoding unit 174. In addition, in Step S205, the same process as that in Step S202 is performed.

In Step S206, the gain adjustment unit 218 adjusts the gain of the audio data supplied from the downmixing unit 217 on the basis of the information which is read from "ext_downmixing_global_gains( )" and is supplied from the downmix information decoding unit 174.

Specifically, the gain adjustment unit 218 calculates Expression (9) on the basis of "dmx_gain_2_sign" and "dmx_gain_2_idx" which are read from "ext_downmixing_global_gains( )" and supplies audio data obtained by the calculation to the output unit 63.

In Step S207, the output unit 63 outputs the audio data supplied from the gain adjustment unit 218 to the next stage, without any change in the audio data. Then, the downmixing process ends. In this way, the process in Step S118 of FIG. 36 ends. Therefore, the decoding process ends.

When it is determined in Step S199 that the audio data is not an output from 2 channels, that is, the audio data is an output from 5.1 channels, the process proceeds to Step S208 and downmixing from 7.1 channels or 6.1 channels to 5.1 channels is performed.

In this case, the switching unit 211 supplies the audio data supplied from the switching unit 151 to the switching unit 212. The switching unit 212 supplies the audio data supplied from the switching unit 211 to any one of the downmixing units 213-1 to 213-4 on the basis of the information about speaker arrangement which is supplied from the PCE decoding unit 161. In addition, the output destination of the switching unit 214 is the gain adjustment unit 215.

In Step S208, the downmixing unit 213 performs downmixing to 5.1 channels on the basis of "dmix_a_idx" and "dmix_b_idx" which are read from "ext_downmixing_levels( )" and are supplied from the downmix information decoding unit 174. In Step S208, the same process as that in Step S201 is performed.

When downmixing to 5.1 channels is performed and the audio data is supplied from the downmixing unit 213 to the switching unit 214, the switching unit 214 supplies the supplied audio data to the gain adjustment unit 215.

In Step S209, the gain adjustment unit 215 adjusts the gain of the audio data supplied from the switching unit 214 on the basis of the information which is read from "ext_downmixing_global_gains( )" and is supplied from the downmix information decoding unit 174.

Specifically, the gain adjustment unit 215 calculates Expression (7) on the basis of "dmx_gain_5_sign" and "dmx_gain_5_idx" which are read from "ext_downmixing_global_gains( )" and supplies audio data obtained by the calculation to the output unit 63.

In Step S210, the output unit 63 outputs the audio data supplied from the gain adjustment unit 215 to the next stage, without any change in the audio data. Then, the downmixing process ends. In this way, the process in Step S118 of FIG. 36 ends. Therefore, the decoding process ends.

In this way, the decoding device 141 downmixes audio data on the basis of the information read from the encoded bit stream.

For example, in the encoded bit stream, since "pseudo_surround_enable" is included in the DSE, it is possible to perform a downmixing process from 5.1 channels to 2 channels using a method which is most suitable for audio data among a plurality of methods. Therefore, a high-quality realistic sound can be obtained on the decoding side.

In addition, in the encoded bit stream, information indicating whether extended information is included is stored in "ancillary_data_extension_status". Therefore, it is possible to specify whether the extended information is included in the extended region with reference to the information. When the extended information can be obtained, it is possible to improve flexibility in the downmixing of audio data. Therefore, it is possible to obtain a high-quality realistic sound.

The above-mentioned series of processes may be performed by hardware or software. When the series of processes is performed by software, a program forming the software is installed in a computer. Here, examples of the computer include a computer which is incorporated into dedicated hardware and a general-purpose personal computer in which various kinds of programs are installed and which can execute various kinds of functions.

Figure 40:
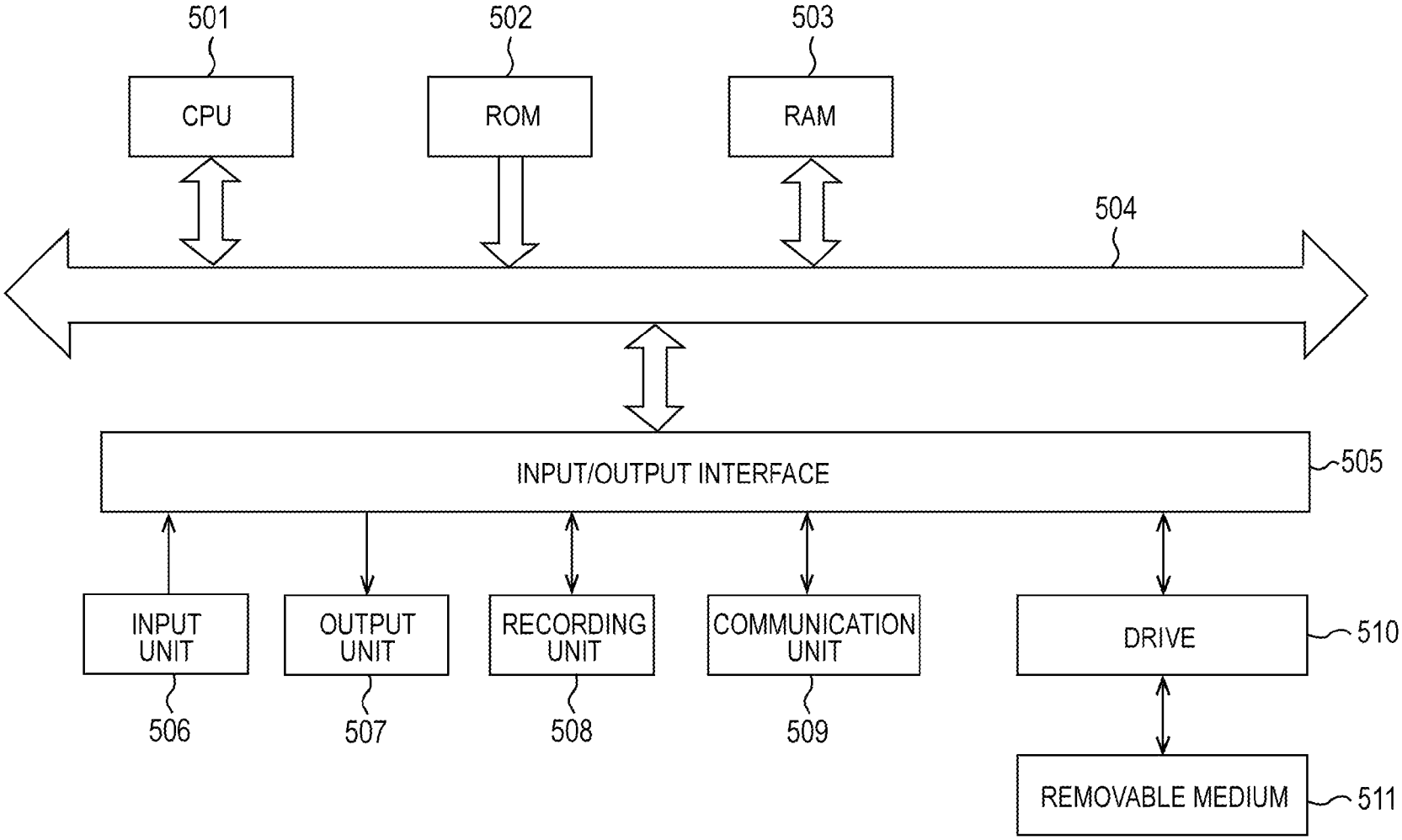
FIG. 40 is a diagram illustrating an example of the structure of a computer.

FIG. 40 is a block diagram illustrating an example of the hardware structure of the computer which executes a program to perform the above-mentioned series of processes.

In the computer, a central processing unit (CPU) 501, a read only memory (ROM) 502, and a random access memory (RAM) 503 are connected to each other by a bus 504.

An input/output interface 505 is connected to the bus 504. An input unit 506, an output unit 507, a recording unit 508, a communication unit 509, and a drive 510 are connected to the input/output interface 505.

The input unit 506 includes, for example, a keyboard, a mouse, a microphone, and an imaging element. The output unit 507 includes, for example, a display and a speaker. The recording unit 508 includes a hard disk and a non-volatile memory. The communication unit 509 is, for example, a network interface. The drive 510 drives a removable medium 511 such as a magnetic disk, an optical disk, a magneto-optical disk, or a semiconductor memory.

In the computer having the above-mentioned structure, for example, the CPU 501 loads the program which is recorded on the recording unit 508 to the RAM 503 through the input/output interface 505 and the bus 504. Then, the above-mentioned series of processes is performed.

The program executed by the computer (CPU 501) can be recorded on the removable medium 511 as a package medium and then provided. Alternatively, the programs can be provided via a wired or wireless transmission medium such as a local area network, the Internet, or digital satellite broadcasting.

In the computer, the removable medium 511 can be inserted into the drive 510 to install the program in the recording unit 508 through the input/output interface 505. In addition, the program can be received by the communication unit 509 through a wired or wireless transmission medium and then installed in the recording unit 508. Alternatively, the program can be installed in the ROM 502 or the recording unit 508 in advance.

The programs to be executed by the computer may be programs for performing operations in chronological order in accordance with the sequence described in this specification, or may be programs for performing operations in parallel or performing an operation when necessary, such as when there is a call.

The embodiment of the present technique is not limited to the above-described embodiment, but various modifications and changes of the embodiment can be made without departing from the scope and spirit of the present technique.

For example, the present technique can have a cloud computing structure in which one function is shared by a plurality of devices through the network and is cooperatively processed by the plurality of devices.

In the above-described embodiment, each step described in the above-mentioned flowcharts is performed by one device. However, each step may be shared and performed by a plurality of devices.

In the above-described embodiment, when one step includes a plurality of processes, the plurality of processes included in the one step are performed by one device.

However, the plurality of processes may be shared and performed by a plurality of devices.

In addition, the present technique can have the following structure.

[1]

A decoding device including:

a decoding unit that decodes audio data included in an encoded bit stream;

a reading unit that reads sound source position information about a height of a sound source of the audio data from a region which can store arbitrary data of the encoded bit stream; and an output unit that outputs the decoded audio data on the basis of the sound source position information.

[2]

In the decoding device according to [1], the sound source position information is information indicating that the height of the sound source is substantially equal to a height of a user, is greater than the height of the user, or is less than the height of the user.

[3]

In the decoding device according to [1] or [2], identification information for identifying whether the sound source position information is present is stored in the region which can store the arbitrary data, and the reading unit reads the sound source position information on the basis of the identification information.

[4]

In the decoding device according to [3], first predetermined identification information and second identification information which is calculated on the basis of the sound source position information are stored as the identification information in the region which can store the arbitrary data.

[5]

In the decoding device according to [4], the reading unit determines that the sound source position information is valid when the first identification information included in the region which can store the arbitrary data is predetermined specific information and the second identification information read from the region which can store the arbitrary data is identical to the second identification information which is calculated on the basis of the read sound source position information.

[6]

In the decoding device according to [5], the second identification information is calculated on the basis of information obtained by performing byte alignment for information including the sound source position information.

[7]

A decoding method including:

a step of decoding audio data included in an encoded bit stream;

a step of reading sound source position information about a height of a sound source of the audio data from a region which can store arbitrary data of the encoded bit stream; and a step of outputting the decoded audio data on the basis of the sound source position information.

[8]

A program that causes a computer to perform a process including:

a step of decoding audio data included in an encoded bit stream;

a step of reading sound source position information about a height of a sound source of the audio data from a region which can store arbitrary data of the encoded bit stream; and a step of outputting the decoded audio data on the basis of the sound source position information.

[9]

An encoding device including:

an acquisition unit that acquires sound source position information about a height of a sound source;

an encoding unit that encodes audio data and the sound source position information; and a packing unit that stores the encoded sound source position information in a region which can store arbitrary data and generates an encoded bit stream including the encoded audio data and the encoded sound source position information.

[10]

In the encoding device according to [9], the sound source position information is information indicating that the height of the sound source is substantially equal to a height of a user, is greater than the height of the user, or is less than the height of the user.

[11]

In the encoding device according to [9] or [10], the sound source position information and identification information for identifying whether the sound source position information is present are stored in the region which can store the arbitrary data.

[12]

In the encoding device according to [11], first predetermined identification information and second identification information which is calculated on the basis of the sound source position information are stored as the identification information in the region which can store the arbitrary data.

[13]

In the encoding device according to [12], information for instructing the execution of byte alignment for information including the sound source position information and information for instructing comparison between the second identification information which is calculated on the basis of information obtained by the byte alignment and the second identification information stored in the region which can store the arbitrary data are further stored in the region which can store the arbitrary data.

[14]

An encoding method including:

a step of acquiring sound source position information about a height of a sound source;

a step of encoding audio data and the sound source position information; and a step of storing the encoded sound source position information in a region which can store arbitrary data and generating an encoded bit stream including the encoded audio data and the encoded sound source position information.

[15]

A program that causes a computer to perform a process including:

a step of acquiring sound source position information about a height of a sound source;

a step of encoding audio data and the sound source position information; and a step of storing the encoded sound source position information in a region which can store arbitrary data and generating an encoded bit stream including the encoded audio data and the encoded sound source position information.

REFERENCE SIGNS LIST

11 Encoding device

21 Input unit

22 Encoding unit
23 Packing unit
51 Decoding device
61 Separation unit
62 Decoding unit
63 Output unit
91 Encoding device
101 PCE encoding unit
102 DSE encoding unit
103 Audio element encoding unit
111 Synchronous word encoding unit
112 Arrangement information encoding unit
113 Identification information encoding unit
114 Extended information encoding unit
115 Downmix information encoding unit
141 Decoding device
152 Downmix processing unit
161 PCE decoding unit
162 DSE decoding unit
163 Audio element decoding unit
171 Synchronous word detection unit
172 Identification information calculation unit
173 Extension detection unit
174 Downmix information decoding unit
181 Rearrangement processing unit

The invention claimed is:

1. A decoding device comprising:

processing circuitry including:

a decoding unit configured to decode audio data included in an encoded bit stream;

a reading unit configured to read sound source position information about a height of a sound source of the audio data from a region which can store arbitrary data of the encoded bit stream; and an output unit configured to output the decoded audio data on the basis of the sound source position information, wherein the sound source position information is information indicating that the height of the sound source is substantially equal to a height of a user, is greater than the height of the user, or is less than the height of the user, wherein identification information for identifying whether the sound source position information is present is stored in the region which can store the arbitrary data, and the reading unit reads the sound source position information on the basis of the identification information, wherein first predetermined identification information and second identification information which is calculated on the basis of the sound source position information are stored as the identification information in the region which can store the arbitrary data, and wherein the reading unit determines that the sound source position information is valid when the first identification information included in the region which can store the arbitrary data is predetermined specific information and the second identification information read from the region which can store the arbitrary data is identical to the second identification information which is calculated on the basis of the read sound source position information.

2. The decoding device according to claim 1, wherein the second identification information is calculated on the basis of information obtained by performing byte alignment for information including the sound source position information.

3. A decoding method comprising:

decoding, by processing circuitry, audio data included in an encoded bit stream;

reading, by the processing circuitry, sound source position information about a height of a sound source of the audio data from a region which can store arbitrary data of the encoded bit stream; and outputting, by the processing circuitry, the decoded audio data on the basis of the sound source position information, wherein the sound source position information is information indicating that the height of the sound source is substantially equal to a height of a user, is greater than the height of the user, or is less than the height of the user, wherein identification information for identifying whether the sound source position information is present is stored in the region which can store the arbitrary data, and the sound source position information is read on the basis of the identification information, wherein first predetermined identification information and second identification information which is calculated on the basis of the sound source position information are stored as the identification information in the region which can store the arbitrary data, and wherein the sound source position information is determined to be valid when the first identification information included in the region which can store the arbitrary data is predetermined specific information and the second identification information read from the region which can store the arbitrary data is identical to the second identification information which is calculated on the basis of the read sound source position information.

4. A computer-readable storage device encoded with computer-executable instructions that, when executed by processing circuitry, perform a process comprising:

decoding audio data included in an encoded bit stream;

reading sound source position information about a height of a sound source of the audio data from a region which can store arbitrary data of the encoded bit stream; and outputting the decoded audio data on the basis of the sound source position information, wherein the sound source position information is information indicating that the height of the sound source is substantially equal to a height of a user, is greater than the height of the user, or is less than the height of the user, wherein identification information for identifying whether the sound source position information is present is stored in the region which can store the arbitrary data, and the sound source position information is read on the basis of the identification information, wherein first predetermined identification information and second identification information which is calculated on the basis of the sound source position information are stored as the identification information in the region which can store the arbitrary data, and wherein the sound source position information is determined to be valid when the first identification information included in the region which can store the arbitrary data is predetermined specific information and the second identification information read from the region which can store the arbitrary data is identical to the second identification information which is calculated on the basis of the read sound source position information.

* * * * *